US008759658B2

(12) United States Patent
Buskies et al.

(10) Patent No.: US 8,759,658 B2
(45) Date of Patent: Jun. 24, 2014

(54) SYSTEM AND METHOD TO GENERATE AND MANIPULATE STRING-INSTRUMENT CHORD GRIDS IN A DIGITAL AUDIO WORKSTATION

(75) Inventors: Christoph Buskies, Hamburg (DE); Alberto E. Scunio, Hamburg (DE); Manfred Knauff, Hamburg (DE); Christof Adam, Norderstedt (DE)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/594,134

(22) Filed: Aug. 24, 2012

(65) Prior Publication Data

US 2013/0205977 A1 Aug. 15, 2013

Related U.S. Application Data

(63) Continuation of application No. 12/505,827, filed on Jul. 20, 2009, now Pat. No. 8,269,094.

(51) Int. Cl.
*G10H 1/38* (2006.01)

(52) U.S. Cl.
USPC ..... 84/613; 84/637; 84/669; 84/715

(58) Field of Classification Search
USPC ..... 84/600–602, 613, 637, 669, 715
See application file for complete search history.

(56) References Cited

U.S. PATENT DOCUMENTS 3,758,698 A * 9/1973 Matyas ..... 84/485 R
3,771,409 A 11/1973 Rickey
4,054,868 A 10/1977 Rose
4,257,306 A 3/1981 Laflamme
4,295,406 A 10/1981 Smith
4,318,327 A 3/1982 Toups
4,384,503 A 5/1983 Gunn
4,412,473 A 11/1983 Laflamme
4,559,861 A 12/1985 Patty et al.
4,671,159 A 6/1987 Stark
4,763,558 A * 8/1988 Johnson, Jr. ..... 84/485 R
4,915,005 A 4/1990 Shaffer
5,029,507 A * 7/1991 Bezeau, Jr. ..... 84/485 SR
5,107,743 A 4/1992 Decker
5,396,828 A 3/1995 Farrand
5,429,029 A 7/1995 Mendiola, Jr.
5,594,191 A * 1/1997 Epstein et al. ..... 84/485 R (Continued)

OTHER PUBLICATIONS

"Guitar Chords", Chordbook.com (Available at http://www.chordbook.com/guitarchords.php, last visited on Jul. 10, 2009).

(Continued)

*Primary Examiner* — David S. Warren
(74) *Attorney, Agent, or Firm* — Kilpatrick Townsend & Stockton LLP

(57) ABSTRACT

A system and method that enables a user to generate and manipulate string-instrument chord grids in a digital audio workstation. The system and method for generating a string-instrument chord grid includes receiving first data input and second data input. The first data input can include a chord root note and/or a position for one or more fingering dots. The second data input can include an instrument type and our tuning for one or more strings. Using the received data input, a processor generates an entered string-instrument chord based and displays the entered string-instrument chord on a grid. The processor can also generate and display the musical name of the entered string-instrument chord.

21 Claims, 19 Drawing Sheets

(56) References Cited

U.S. PATENT DOCUMENTS

| | | | | |
|---|---|---|---|---|
| 5,597,971 | A | 1/1997 | Saito | |
| 5,639,977 | A | 6/1997 | Hesnan | |
| 5,852,252 | A | 12/1998 | Takano | |
| 5,907,115 | A | 5/1999 | Matsunaga et al. | |
| 6,005,180 | A | 12/1999 | Masuda | |
| 6,084,167 | A | 7/2000 | Akimoto et al. | |
| 6,087,577 | A | 7/2000 | Yahata et al. | |
| 6,107,557 | A | 8/2000 | Fukada | |
| 6,188,008 | B1 | 2/2001 | Fukada | |
| 6,201,174 | B1 | 3/2001 | Eller | |
| 6,239,344 | B1 | 5/2001 | Prevost | |
| 6,423,893 | B1 | 7/2002 | Sung et al. | |
| 6,515,211 | B2 | 2/2003 | Umezawa et al. | |
| 6,870,085 | B2 | 3/2005 | MacCutcheon | |
| 6,995,310 | B1 | 2/2006 | Knapp et al. | |
| 7,109,407 | B2 * | 9/2006 | Hasegawa | 84/613 |
| 7,196,260 | B2 | 3/2007 | Schultz | |
| 7,223,913 | B2 | 5/2007 | Knapp et al. | |
| 7,288,711 | B2 * | 10/2007 | Hasegawa | 84/613 |
| 7,355,110 | B2 | 4/2008 | Nash | |
| 7,381,878 | B2 | 6/2008 | Cook | |
| 7,446,253 | B2 | 11/2008 | Knapp et al. | |
| 7,485,797 | B2 | 2/2009 | Sumita | |
| 7,521,619 | B2 | 4/2009 | Salter | |
| 7,560,635 | B2 | 7/2009 | Funaki | |
| 7,582,824 | B2 | 9/2009 | Sumita | |
| 7,608,774 | B2 | 10/2009 | Ohmuru | |
| 8,269,094 | B2 | 9/2012 | Buskies et al. | |
| 2002/0050206 | A1 | 5/2002 | MacCutcheon | |
| 2002/0177113 | A1 | 11/2002 | Sherlock | |
| 2002/0194983 | A1 | 12/2002 | Tanner | |
| 2003/0000364 | A1 | 1/2003 | Deverich | |
| 2003/0051595 | A1 * | 3/2003 | Hasegawa | 84/637 |
| 2004/0224295 | A1 | 11/2004 | Harrison | |
| 2005/0183566 | A1 | 8/2005 | Nash | |
| 2006/0027080 | A1 * | 2/2006 | Schultz | 84/613 |
| 2006/0065101 | A1 | 3/2006 | Funaki | |
| 2006/0107826 | A1 | 5/2006 | Knapp et al. | |
| 2006/0191399 | A1 | 8/2006 | Miyaki | |
| 2006/0201311 | A1 * | 9/2006 | Hasegawa | 84/613 |
| 2006/0207411 | A1 | 9/2006 | Ohmura et al. | |
| 2006/0278062 | A1 | 12/2006 | Cook | |
| 2007/0256551 | A1 | 11/2007 | Knapp et al. | |
| 2008/0034947 | A1 | 2/2008 | Sumita | |
| 2009/0126553 | A1 | 5/2009 | Murray | |
| 2010/0137049 | A1 | 6/2010 | Epstein | |
| 2010/0236381 | A1 | 9/2010 | Ikeda et al. | |
| 2010/0294112 | A1 | 11/2010 | Asakura et al. | |
| 2011/0003638 | A1 | 1/2011 | Lee et al. | |
| 2011/0011246 | A1 * | 1/2011 | Buskies et al. | 84/613 |
| 2011/0023691 | A1 | 2/2011 | Iwase et al. | |
| 2011/0247479 | A1 * | 10/2011 | Helms et al. | 84/613 |

OTHER PUBLICATIONS

SONAR 4 User's Manual Producer & Studio Edition, Twelve Tone Systems, 2004, pp. 544-546.

Non-Final Office Action for U.S. Appl. No. 12/505,827, mailed on May 11, 2011, 14 pages.

Final Office Action for U.S. Appl. No. 12/505,827, mailed on Nov. 25, 2011, 15 pages.

Notice of Allowance for U.S. Appl. No. 12/505,827, mailed on May 17, 2012, 8 pages.

* cited by examiner

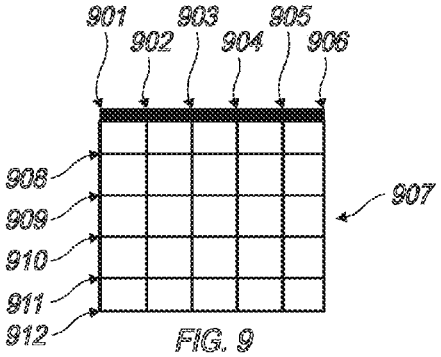
FIG. 9
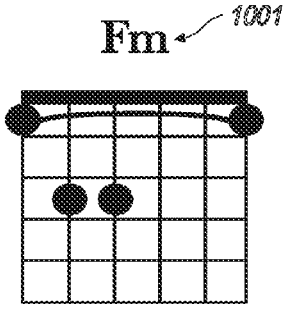
FIG. 10
| | Staff | | | | | | | | | |
|---|---|---|---|---|---|---|---|---|---|---|
| | | { | [ | E | I | ⇑ Space ⇓ | Size | Clef | | |
| ▷ | 1 | | | | | 300 90 | 15 | TAB Bass 4 | # | |
| | | | | | | | | | | |
| | | | | | | | | | | |
| | | | | | | | | | | |
FIG. 11
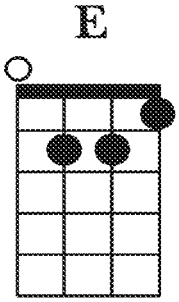
FIG. 12

| | | | | | |
|---|---|---|---|---|---|
| ▸ 4 String Basses | | E1 A1 D2 G2 | 4 | 4 | 4 |
| ▾ Default Guitar Tuning | | E2 A2 D3 G3 B3 E4 | 6 | 36 | 24 |
| | Additional Chord Grids | | | 18 | 18 |
| | Factory Library 1 | | | 9 | 3 |
| | Factory Library 2 | | | 9 | 3 |
| | Higher Frets Chords | | | 0 | 0 |
| ▸ My Seven Strings Tuning | | D2 G2 D3 F3 Bb3 D#4 C#4 | 7 | 18 | 6 |
| ▸ 5-String Guitar | | E2 A2 D3 G3 B3 | 5 | 0 | 0 |
| ▾ Banjo 4-String Classic | | C2 G2 B2 D3 | 4 | 0 | 0 |
| | Banjo Easy Chords | | | 0 | 0 |

SYSTEM AND METHOD TO GENERATE AND MANIPULATE STRING-INSTRUMENT CHORD GRIDS IN A DIGITAL AUDIO WORKSTATION

CROSS-REFERENCES TO RELATED APPLICATIONS

This application is a continuation of U.S. patent application Ser. No. 12/505,827, filed Jul. 20, 2009, the disclosure of which is incorporated by reference herein.

FIELD

The following relates to computing devices capable of and methods for sequencing music, and more particularly to approaches for generating and manipulating string-instrument chord grids in a digital audio workstation.

BACKGROUND OF THE INVENTION

Artists can use software to create musical arrangements. This software can be implemented on a computer to allow an artist to write, record, edit, and mix musical arrangements. Typically, such software can allow the artist to arrange files on musical tracks in a musical arrangement. A computer that includes the software can be referred to as a digital audio workstation (DAW). TheDAW can display a graphical user interface (GUI) to allow a user to manipulate files on tracks. The DAW can display each element of a musical arrangement, such as a guitar, microphone, or drums, on separate tracks. For example, a user may create a musical arrangement with a guitar on a first track, a piano on a second track, and vocals on a third track. The DAW can further break down an instrument into multiple tracks. For example, a drum kit can be broken into multiple tracks with the snare, kick drum, and hi-hat each having its own track. By placing each element on a separate track a user is able to manipulate a single track, without affecting the other tracks. For example, a user can adjust the volume or pan of the guitar track, without affecting the piano track or vocal track. As will be appreciated by those of ordinary skill in the art, using the GUI, a user can apply different effects to a track within a musical arrangement. For example, volume, pan, compression, distortion, equalization, delay, and reverb are some of the effects that can be applied to a track.

Typically, a DAW works with two main types of files: MIDI (Musical Instrument Digital Interface) files and audio files. MIDI is an industry-standard protocol that enables electronic musical instruments, such as keyboard controllers, computers, and other electronic equipment, to communicate, control, and synchronize with each other. MIDI does not transmit an audio signal or media, but rather transmits "event messages" such as the pitch and intensity of musical notes to play, control signals for parameters such as volume, vibrato and panning, cues, and clock signals to set the tempo. As an electronic protocol, MIDI is notable for its widespread adoption throughout the industry.

An ability to read or write music may not be required to compose music. However, the recordation and communication of a musical arrangement in the form of a musical score is desirable. Such a score enables subsequent performances by the composer or by other musicians. A well-crafted and detailed score can communicate information including, but not limited to pitches, timings, volumes, and techniques. Without a well-crafted and detailed score, the musical techniques and innovations underlying an arrangement may be lost and unrepeatable. A musical score can be in any form, including classical musical notation, sheet music, and string-instrument tablature. The score can be used as a record of, a guide to, or a means to perform, a piece of music. Although it does not take the place of the sound of a performed work, sheet music can be studied to create a performance and to elucidate aspects of the music that may not be obvious from mere listening. A need exists, therefore, for a system and method that would enable musicians to create musical scores. It would be desirable to implement such a system and method into a DAW.

BRIEF SUMMARY OF THE INVENTION

As introduced above, users may desire to create a musical score in different formats, including classical musical notations, sheet music, and string-instrument tablature. Certain embodiments relate to methods and systems for generating, manipulating, and cataloging string-instrument chord grids and inserting the chord grids into a musical score. In some embodiments, a chord grid showing the fingering of a string-instrument chord can be generated based on a root note, and/or a position for one or more fingerings, in combination with an instrument type, and/or a tuning for one or more strings. In addition to or as an alternative to generating chord grids certain embodiments generate chord names, and/or difficulty ratings for particular chords. One or more embodiments provide a playback mechanism that allows users to hear a generated chord. One or more embodiments can provide a library cataloging chord grids for various instruments and instrument tunings, which can be manipulated by user input, and which can be inserted into a musical score. Once multiple chord grids are entered into a score, certain embodiments can determine a difficulty factor associated with playing the chords in sequence. Based on the determined difficulty factor, certain embodiments can recommend alternate fingerings that may prove easier to play.

Many other aspects and examples will become apparent from the following disclosure.

BRIEF DESCRIPTION OF THE DRAWINGS

In order to further explain describe various aspects, examples, and inventive embodiments, the following figures are provided, in which:

FIG. 9 depicts a schematic of a blank chord grid and various features thereof in accordance with an exemplary embodiment;

FIG. 10 depicts a schematic of a chord grid including a chord fingering in accordance with an exemplary embodiment;

FIG. 11 depicts a schematic of a staff style menu in accordance with an exemplary embodiment;

FIG. 12 depicts a schematic of a chord grid generated based on the staff style settings specified in the staff style menu of FIG. 11 in accordance with an exemplary embodiment;

DETAILED DESCRIPTION OF THE INVENTION

The functions described as being performed at various components can be performed at other components, and the various components can be combined and/or separated. Other modifications also can be made.

Thus, the following disclosure describes systems, computer readable media, devices, and methods for generating, manipulating, and cataloging string-instrument chord grids and inserting chord grids into a musical score. Many other examples and other characteristics will become apparent from the following description.

Figure 1:
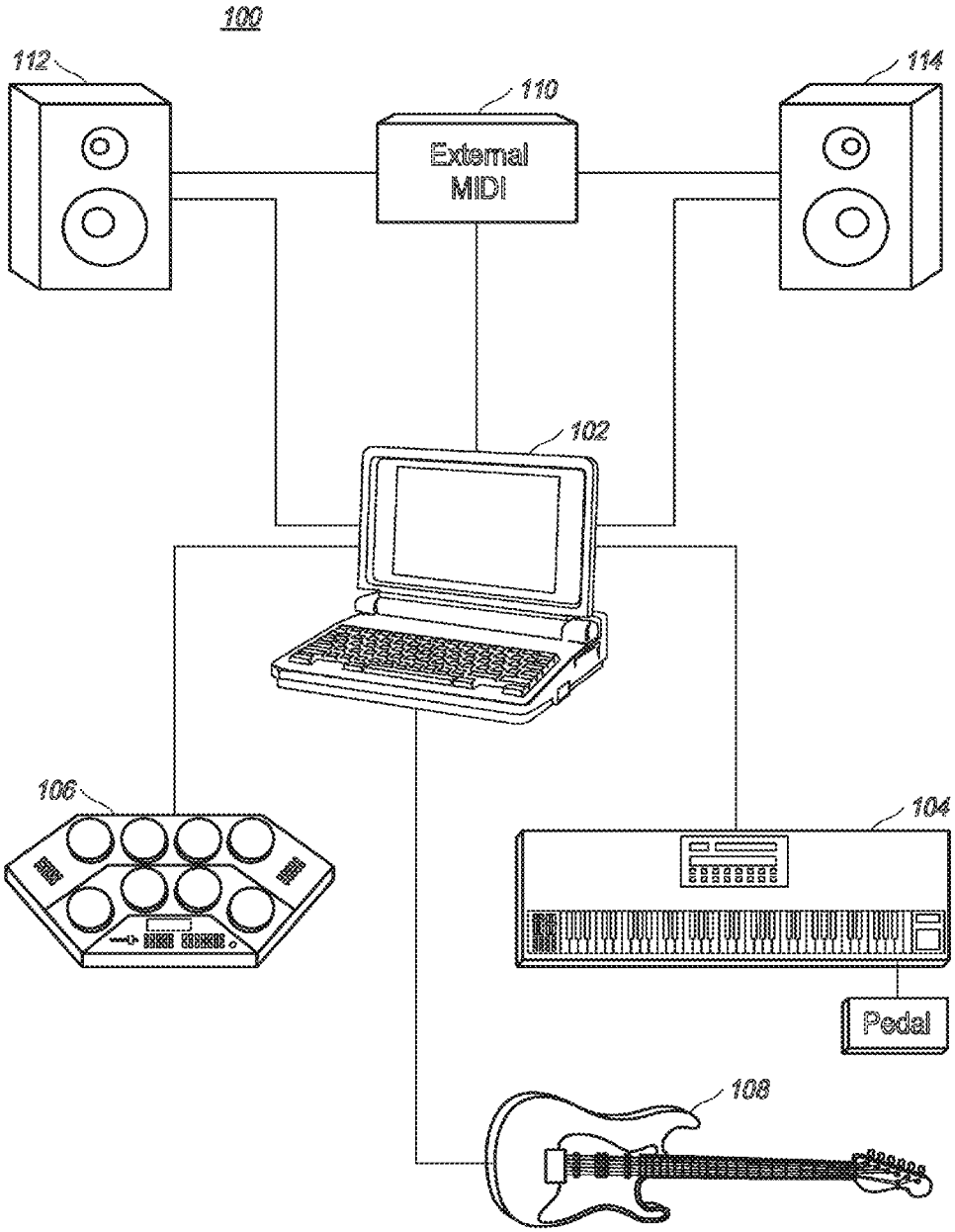
FIG. 1 depicts a block diagram of a system having a DAW musical arrangement in accordance with an exemplary embodiment.

Referring to FIG. 1, a block diagram of a system including a DAW in accordance with an exemplary embodiment is illustrated. As shown, the system 100 can include a computer 102, one or more sound output devices 112, 114, one or more MIDI controllers (e.g. a MIDI keyboard 104 and/or a drum pad MIDI controller 106), one or more instruments (e.g. a guitar 108, and/or a microphone (not shown)), and/or one or more external MIDI devices 110. As would be appreciated by one of ordinary skill in the art, the musical arrangement can include more or less equipment as well as different musical instruments.

The computer 102 can be a data processing system suitable for storing and/or executing program code, e.g., the software to operate the GUI which together can be referred to as a, DAW. The computer 102 can include at least one processor, e.g., a first processor, coupled directly or indirectly to memory elements through a system bus. The memory elements can include local memory employed during actual execution of the program code, bulk storage, and cache memories that provide temporary storage of at least some program code in order to reduce the number of times code must be retrieved from bulk storage during execution. Input/output or 110 devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters. In one or more embodiments, the computer 102 can be a desktop computer or a laptop computer.

A MIDI controller is a device capable of generating and sending MIDI data. The MIDI controller can be coupled to and send MIDI data to the computer 102. The MIDI controller can also include various controls, such as slides and knobs that can be assigned to various functions within the DAW. For example, a knob may be assigned to control the pan on a first track. Also, a slider can be assigned to control the volume on a second track. Various functions within the DAW can be assigned to a MIDI controller in this manner. The MIDI controller can also include a sustain pedal and/or an expression pedal. These can affect how a MIDI instrument plays MIDI data. For example, holding down a sustain pedal while recording MIDI data can cause an elongation of the length of the sound played if a piano software instrument has been selected for that MIDI track.

As shown in FIG. 1, the system 100 can include a MIDI keyboard 104 and/or a drum pad controller 106. The MIDI keyboard 104 can generate MIDI data which can be provided to a device that generates sounds based on the received MIDI data. The drum pad MIDI controller 106 can also generate MIDI data and send this data to a capable device which generates sounds based on the received MIDI data. The MIDI keyboard 104 can include piano style keys, as shown. The drum pad MIDI controller 106 can include rubber pads. The rubber pads can be touch and pressure sensitive. Upon hitting or pressing a rubber pad, or pressing a key, the MIDI controller 104, 106 generates and sends MIDI data to the computer 102.

An instrument capable of generating electronic audio signals can be coupled to the computer 102. For example, as shown in FIG. 1, an electrical output of an electric guitar 108 can be coupled to an audio input on the computer 102. Similarly, an acoustic guitar 108 equipped with an electrical output can be coupled to an audio input on the computer 102. In another example, if an acoustic guitar 108 does not have an electrical output, a microphone positioned near the guitar 108 can provide an electrical output that can be coupled with an audio input on the computer 102. The output of the guitar 108 can be coupled to a pre-amplifier (not shown) with the pre-amplifier being coupled to the computer 102. The pre-amplifier can boost the electronic signal output of the guitar 108 to acceptable operating levels for the audio input of computer 102. If the DAW is in a record mode, a user can play the guitar 108 to generate an audio file. Popular effects such as chorus, reverb, and distortion can be applied to this audio file when recording and playing.

The external MIDI device 110 can be coupled to the computer 102. The external MIDI device 110 can include a processor, e.g., a second processor which is external to the first processor of computer 102. The external processor can receive MIDI data from an external MIDI track of a musical arrangement to generate corresponding sounds. A user can utilize such an external MIDI device 110 to expand the quality and/or quantity of available software instruments. For example, a user may configure the external MIDI device 110 to generate electric piano sounds in response to received MIDI data from a corresponding external MIDI track in a musical arrangement from the computer 102.

The computer 102 and/or the external MIDI device 110 can be coupled to one or more sound output devices (e.g., monitors or speakers). For example, as shown in FIG. 1, the computer 102 and the external MIDI device 110 can be coupled to a left monitor 112 and a right monitor 114. In one or more embodiments, an intermediate audio mixer (not shown) may be coupled between the computer 102, or external MIDI device 110, and the sound output devices, e.g., the monitors 112, 114. The intermediate audio mixer can allow a user to adjust the volume of the signals sent to the one or more sound output devices for sound balance control. In other embodiments, one or more devices capable of generating an audio signal can be coupled to the sound output devices 112, 114. For example, a user can couple the output from the guitar 108 to the sound output devices.

The one or more sound output devices can generate sounds corresponding to the one or more audio signals sent to them. The audio signals can be sent to the monitors 112, 114, which can require the use of an amplifier to adjust the audio signals to acceptable levels for sound generation by the monitors 112, 114. The amplifier in this example may be internal or external to the monitors 112, 114.

Although, in this example, a sound card is internal to the computer 102, many circumstances exist where a user can utilize an external sound card (not shown) for sending and receiving audio data to the computer 102. A user can use an external sound card in this manner to expand the number of available inputs and outputs. For example, if a user wishes to record a band live, an external sound card can provide eight (8) or more separate inputs, so that each instrument and vocal can each be recorded onto a separate track in real time. Also, disc jockeys (DJs) may wish to utilize an external sound card for multiple outputs so that the DJ can cross-fade to different outputs during a performance.

Figure 2:
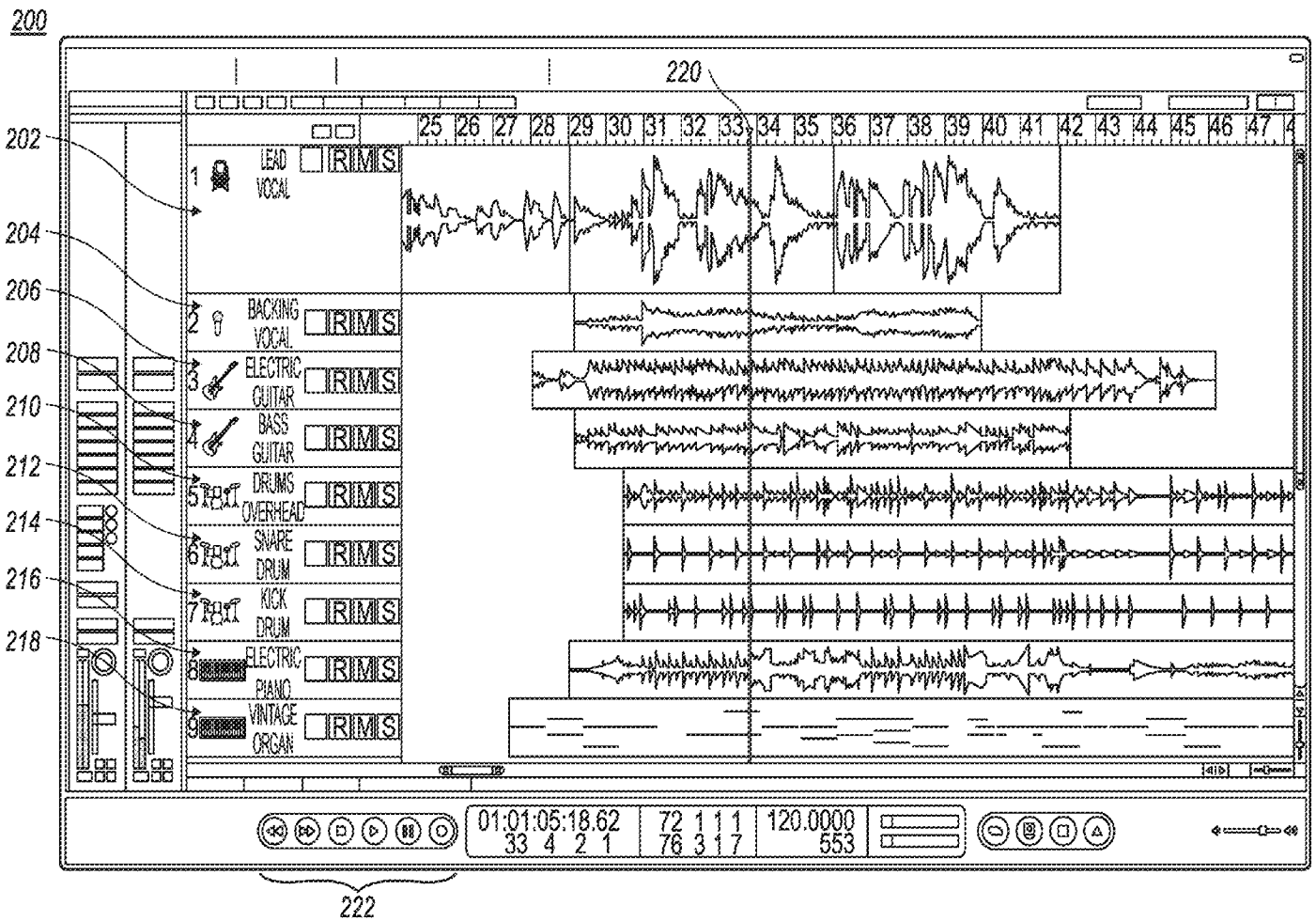
FIG. 2 depicts a screenshot of a GUI of aDAW displaying a musical arrangement including MIDI and audio tracks in accordance with an exemplary embodiment.

Referring to FIG. 2, a screenshot of a musical arrangement in a GUI of a DAW in accordance with an exemplary embodiment is illustrated. The musical arrangement 200 can include one or more tracks with each track having one or more of audio files or MIDI files. Generally, each track can hold audio or MIDI files corresponding to each individual desired instrument. As shown, the tracks are positioned horizontally. A playhead 220 moves from left to right as the musical arrangement is recorded or played. As one of ordinary skill in the art would appreciate, other tracks and playhead 220 can be displayed and/or moved in different manners. The playhead 220 moves along a timeline that shows the position of the playhead within the musical arrangement. The timeline indicates bars, which can be in beat increments. For example as shown, a four (4) beat increment in a 4/4 time signature is displayed on a timeline with the playhead 220 positioned between the thirty-third (33rd) and thirty-fourth (34th) bar of this musical arrangement. A transport bar 222 can be displayed and can include commands for playing, stopping, pausing, rewinding and fast-forwarding the displayed musical arrangement. For example, radio buttons can be used for each command. If a user were to select the play button on transport bar 222, the playhead 220 would begin to move down the timeline, e.g., in a left to right fashion.

As shown, the lead vocal track, 202, is an audio track. One or more audio files corresponding to a lead vocal part of the musical arrangement can be located on this track. In this example, a user has directly recorded audio into the DAW on the lead vocal track. The backing vocal track, 204 is also an audio track. The backing vocal 204 can contain one or more audio files having backing vocals in this musical arrangement. The electric guitar track 206 can contain one or more electric guitar audio files. The bass guitar track 208 can contain one or more bass guitar audio files within the musical arrangement. The drum kit overhead track 210, snare track 212, and kick track 214 relate to a drum kit recording. An overhead microphone can record the cymbals, hit-hat, cow bell, and any other equipment of the drum kit on the drum kit overhead track. The snare track 212 can contain one or more audio files of recorded snare hits for the musical arrangement. Similarly, the kick track 214, can contain one or more audio files of recorded bass kick hits for the musical arrangement. The electric piano track 216 can contain one or more audio files of a recorded electric piano for the musical arrangement.

The vintage organ track 218 is a MIDI track. Those of ordinary skill in the art will appreciate that the contents of the files in the vintage organ track 218 can be shown differently because the track contains MIDI data and not audio data. In this example, the user has selected an internal software instrument, a vintage organ, to output sounds corresponding to the MIDI data contained within this track 218. A user can change the software instrument, for example to a trumpet, without changing any of the MIDI data in track 218. Upon playing the musical arrangement the trumpet sounds would now be played corresponding to the MIDI data of track 218. Also, a user can set up track 218 to send its MIDI data to an external MIDI instrument, as described above.

Each of the displayed audio and MIDI files in the musical arrangement as shown on screen 200 can be altered using the GUI. For example, a user can cut, copy, paste, or move an audio file or MIDI file on a track so that it plays at a different position in the musical arrangement. Additionally, a user can loop an audio file or MIDI file so that it is repeated, split an audio file or MIDI file at a given position, and/or individually time stretch an audio file for tempo, tempo and pitch, and/or tuning adjustments.

One or more embodiments can include a scoring subroutine, processor, and/or method that allow(s) a user to generate various types of musical scores. Organized user access to the scoring subroutine, processor, and/or method can be performed through a part box menu that includes various part box entries displaying categories of various scoring features available to the user. In certain embodiments, such a part box menu can be accessed from the GUI of the DAW.

Figure 3:
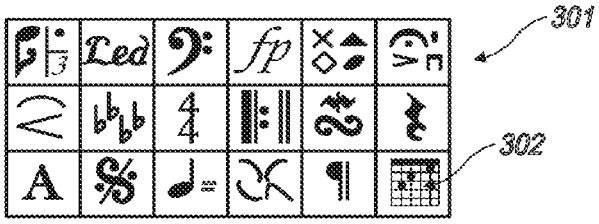
FIG. 3 depicts a screenshot of a part box menu including a chord grid icon in accordance with an exemplary embodiment.

The categories of scoring features represented by part box entries can include, for example, musical notes, time signatures, accents, rests, etc. FIG. 3 depicts a screenshot of a part box menu including a chord grid icon in accordance with an exemplary embodiment. As shown in FIG. 3, according to certain embodiments, the part box menu 301 can be provided with a chord grid icon 302 as a part box entry.

Figure 4:
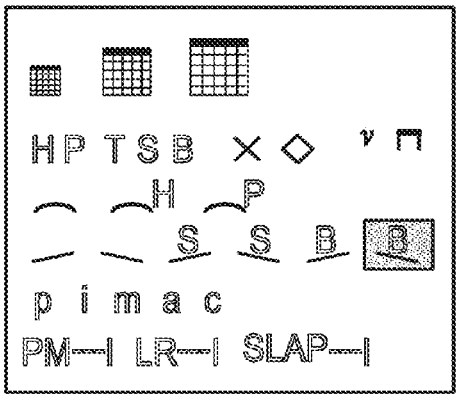
FIG. 4 depicts a schematic of a chord grid part box window in accordance with an exemplary embodiment.
Figure 5:
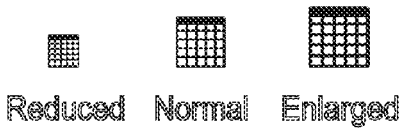
FIG. 5 depicts a schematic of differently-sized chord grid symbols in accordance with an exemplary embodiment.
Figure 6:
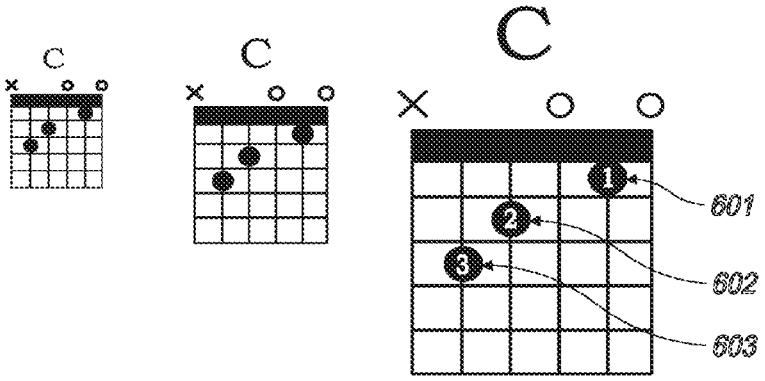
FIG. 6 depicts various chord grid symbols in accordance with an exemplary embodiment.

FIG. 4 depicts a schematic of a chord grid part box window in accordance with an exemplary embodiment. By selecting the chord grid icon in part box menu 301, the user can gain access to a chord grid part box window, as shown, for example, in FIG. 4. The chord grid part box window can display various options for generating and/or manipulating one or more chord grids. The tablature and fingering markings can include, but are not limited to markings indicating one or more of the following: hammer on, pull off, bend string up, release bend, slide up, slide down, vibrato, right hand tap, legato slide, shift slide, natural harmonic, artificial harmonic, tapped harmonic, trill, tap, tremolo picking, palm muting, tremolo bar dip with or without an amount to dip, tremolo bar down, tremolo bar up, tremolo bar inverted dip, hold bend, volume swell louder or softer, muted slash, single note slash, and slap. In one or more embodiments, the chord grid part box window includes multiple chord grid symbols. For example, the chord grid part box wind can include three sizes of chord grid symbols. Additionally or alternatively, the chord grid part box window can include all available tablature and/or fingering markings. FIG. 5 shows a schematic of the three differently-sized chord grid symbols displayed in the chord grid part box shown in FIG. 4. More specifically, FIG. 4 shows a reduced chord grid, a normal chord grid, and an enlarged chord grid. Any number of chord grid sizes can be employed. A user may choose to employ a smaller chord grid when the song is familiar, or intends to focus a performer's attention to classical musical notation or string-instrument tablature provided in the score. A user may choose to employ a larger chord grid when the chords are not familiar, when the chord fingerings are difficult, or when the user intends to focus a performer's attention on the chord grids. FIG. 6 depicts various chord grid symbols in accordance with an exemplary embodiment. More specifically, FIG. 6 shows chord grids generated in three different sizes and showing varying levels of detail. The largest finished chord grid shown in FIG. 6 includes fingering numbers 601, 602, and 603.

According to one or more embodiments, the user can be provided with one or more factory chord grid libraries for a variety of instruments and instrument tunings. For example, a library of chord grids can be provided for "normal" and common "open" guitar tunings Normal guitar tuning on a 6-string guitar includes the following notes from lowest pitch to highest pitch: E (at about 82.4 Hz), A (at about 110.0 Hz), D (at about 146.8 Hz), G (at about 196.0 Hz), B (at about 246.9 Hz), and E (at about 329.6 Hz). Open tuning for a 6-string guitar is one where the strings are tuned so that a chord is achieved without fretting, or pressing any of the strings. With such a tuning, other chords can be played by barring a fret or through the use of a slide.

Despite the usefulness and prevalence of "normal" tuning, some musicians employ alternative tuning arrangements in order to exploit the unique chord voicing and sonorities that result from them. Thus, the library may contain one or more alternative tunings. For example, a chord grid library for a 6-string guitar may contain chord grids for dropped tunings, higher tunings, and drop-D tunings. In "dropped tunings" the guitar is tuned to standard and all the strings are down-tuned by the same degree. In "higher tunings" the guitar is tuned to standard and all the strings are tuned up by the same degree. "Drop-D tunings" have the 6th string tuned one full step below the other strings. According to one or more embodiments alternative tunings can change the chord shapes associated with standard tuning to provide chords that are easier or more difficult to play. Difficulty factors for individual chords and for sequences of chords are discussed below, in greater detail.

Figure 7:
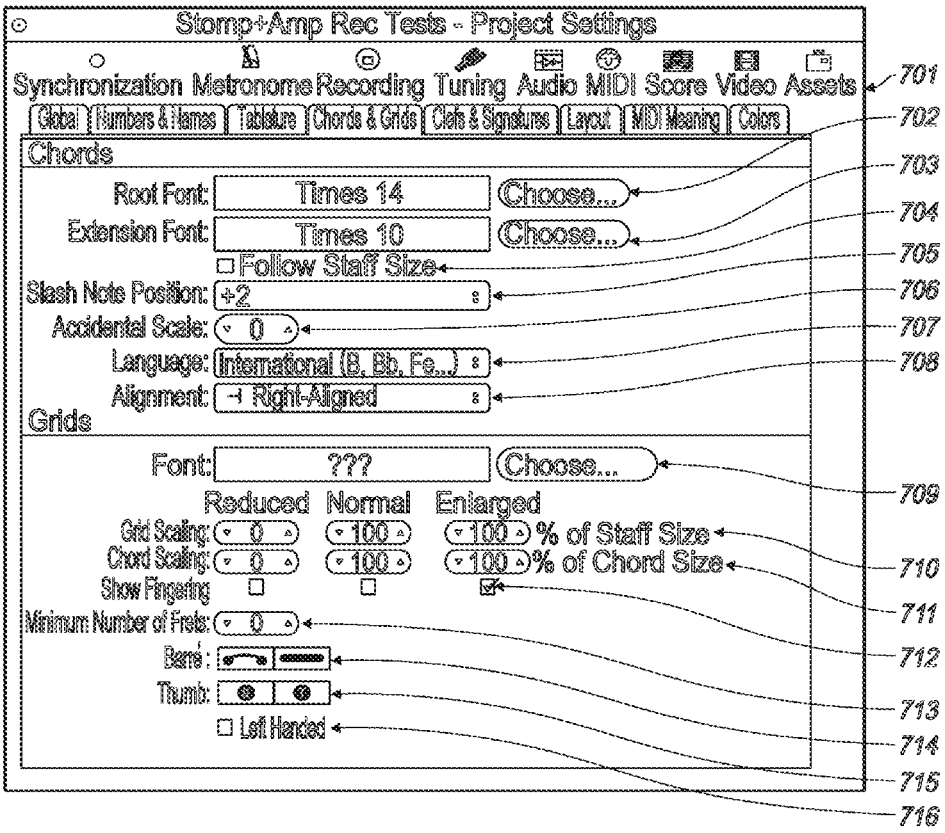
FIG. 7 depicts a screenshot of a chords and grids settings menu in accordance with an exemplary embodiment.

One or more embodiments can include a chords and grids settings subroutine, processor, and/or method that allows the user to determine the appearance for chords and grids. FIG. 7 depicts a screenshot of a chords and grids settings menu in accordance with an exemplary embodiment. Input/output control of the chords and grids settings subroutine, processor, and/or method can be performed through a chords and grids settings menu 701, as illustrated in FIG. 7. The chords and grids settings menu can provide a convenient user-interface.

The chords and grids settings menu 701 can include a section of features for adjusting the characteristics of chords and/or grids. For example, the chords and grids settings menu 701 can include a root font setting 702, an extension font setting 703, a follow staff toggle setting 704, a slash note position setting 705, an accidental scale setting 706, a language setting 707, and an alignment setting 708.

The chords and grids settings menu 701 can include a section of features for adjusting the characteristics of grids. For example, the adjustable settings can include a font setting 709 to allow the user to specify a font and font size to use with a chord grid. The chords and grids settings menu can include adjustable settings for all sizes of chord grids. For example, in an embodiment where three chord grid sizes are provided (for example, reduced, normal, and enlarged), the chords and grids settings menu can allow a user to adjust settings for differently-sized chord grids. The adjustable settings can include a grid scaling setting 710, which allows the user to specify the size of a chord grid relative to the size of a musical staff about which (for example, above which) the chord grid is to be displayed. The grid scaling setting can specify the size of the chord grid as a percentage of the staff size. The adjustable settings can include a chord scaling setting 711, which allows the user to specify chord scaling as a percentage of chord size. The adjustable settings can include a show-fingering toggle setting 712, which allows a user to specify whether fingering indicators should be displayed on the finger position markers. The fingering indicators can be fingering numbers. Fingering numbers can range from 1-5, where the numbers specify a finger depressing a particular string on the neck of a string-instrument. The adjustable settings can include a thumb number setting 715, which allows the user to assign a particular fingering number to the thumb. For example, the number 1 can correspond to the index finger, the number 2 can correspond to the middle finger, the number 3 corresponds to the ring finger, the number 4 corresponds to the pinky, and the number 5 corresponds to the thumb. The thumb number setting 715 can allow the user to specify a number as the fingering number for the thumb. Alternatively, the thumb number setting 715 can allow the user to specify either 1 or 5 as the fingering number for the thumb. The adjustable settings can include a minimum number of frets setting 713, which allows a user to specify the number of frets to be displayed on the chord grid. Frets are represented on a chord grid as horizontal lines. The adjustable settings can include a barré setting 714, which allows the user to specify a style of bane to be displayed on a chord grid. The adjustable settings can include left-handed toggle setting 716, which allows the user to toggle between left-handed and right-handed chord grids.

Figure 8:
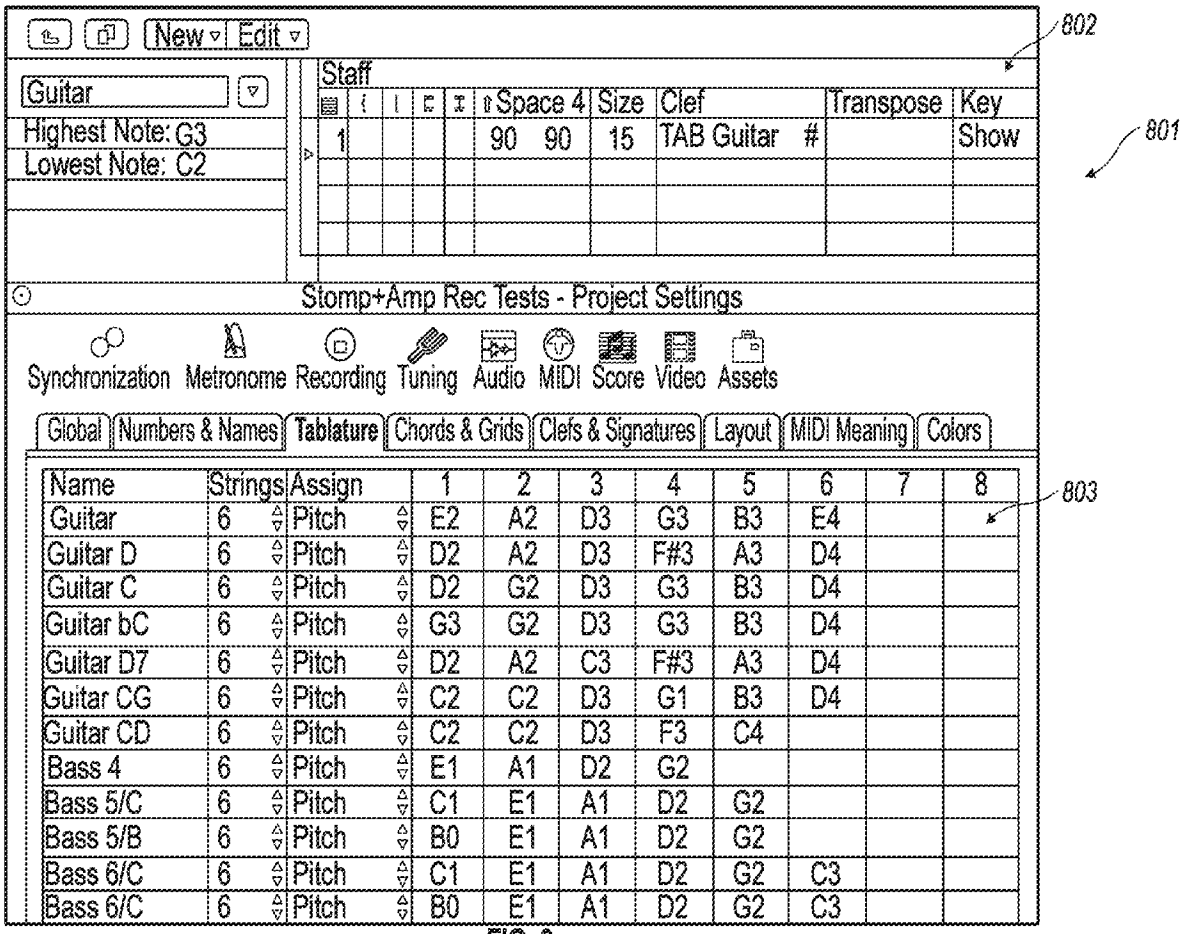
FIG. 8 depicts a screenshot of a tablature score project settings menu in accordance with an exemplary embodiment.

One or more embodiments can include a chord grid insertion subroutine, processor, and/or method that allows the user to insert chord grids into string-instrument tablature and/or into classical musical notation. Prior to the insertion of chord grids into string-instrument tablature and/or into classical musical notation, chord and grid settings can be determined. FIG. 8 depicts a screenshot of a tablature score project settings menu in accordance with an exemplary embodiment. When a chord grid is to be inserted into a string-instrument tablature notation, chord and grid settings can be determined automatically based on a staff style 802 already specified by user input. The user input can be entered into a tablature score project settings menu 801 as shown in FIG. 8. The staff style can include characteristics, specifications, and/or information relevant for determining the appropriate chord and grid settings. Some or all of these characteristics, specifications, and/or information can be stored in a database and accessible through tablature interface 803 on the tablature score project settings menu 801. The chord and grid settings determinable from the staff style include, but are not limited to the number of strings, the tuning, and the capo position.

FIG. 9 depicts a schematic of a blank chord grid and various features thereof in accordance with an exemplary embodiment. By way of example, but not limitation, to insert a chord grid into a string-instrument tablature having a staff style specifying "normal" 6-string guitar tuning, with no capo, chord and grid settings can be determined automatically based on the staff style. Based on the staff style, a chord grid 907 as shown in FIG. 9 can be generated. Based on the parameters determinable based on the staff style, the notes of the 6-strings can be determined as follows: the first string 901 will be E (at about 82.4 Hz), the second string 902 will be A (at about 110.0 Hz), the third string 903 will be D (at about 146.8 Hz), the fourth string 904 will be G (at about 196.0 Hz), the fifth string 905 will be B (at about 246.9 Hz), and the sixth string 906 will be E (at about 329.6 Hz). FIG. 9 also illustrates five frets, including a first fret 908, a second fret 909, a third fret 910, a fourth fret 911, and a fifth fret 912.

When a user specifies the chord and grid settings used to generate the blank chord grid illustrated in FIG. 9, and a root note, certain embodiments can generate a finished chord grid showing a chord fingering. For example, FIG. 10 depicts a schematic of a chord grid including a chord fingering in accordance with an exemplary embodiment. More specifically, the fingering for an F minor chord, is shown in FIG. 10. According to one or more embodiments, other variations of F-minor chords can be generated and displayed with or without additional user input. In one or more embodiments, the different fingering variations can be stored in a database and retrieved when needed. In one or more embodiments, an algorithm can be used to generate the fingering variations. The algorithm can transpose the finger of the chord and/or generate all possible fingerings including the appropriate notes of the chord.

By way of another non-limiting example, FIG. 11 depicts a schematic of a staff style menu in accordance with an exemplary embodiment. Chord and grid settings can be determined automatically based on the staff style shown in FIG. 11, specifying "Bass tuning, 4 strings, no Capo." After automatically determining the chord and grid settings, based on the staff style shown in FIG. 11, the DAW can generate a chord grid showing a chord fingering based on a user input. For example, FIG. 12 depicts a schematic of a chord grid generated based on the staff style settings specified in the staff style menu of FIG. 11 in accordance with an exemplary embodiment. Based on a user inputted root note "E," an E chord can be generated, as shown in FIG. 12.

Figure 13:
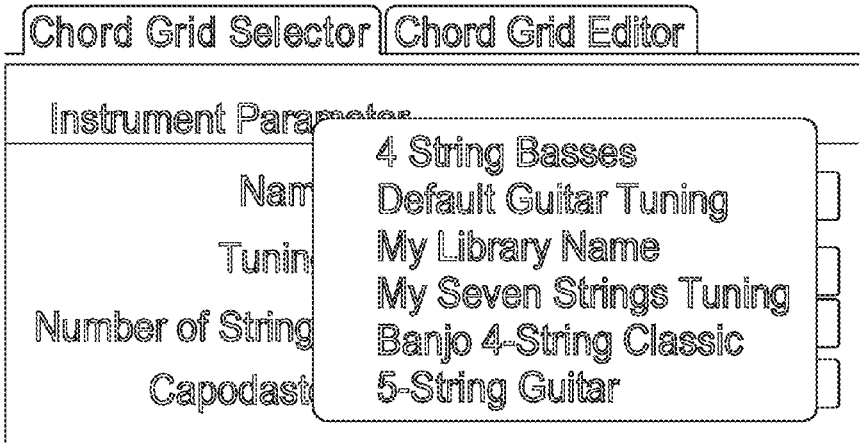
FIG. 13 depicts a screenshot of a chord grid selector menu in accordance with an exemplary embodiment.

The chord grid insertion subroutine, processor, and/or method can allow the user to insert chord grids into classical musical notation. Classical musical notation and other non-tablature staff styles have no relation to the tunings provided by the tablature score project settings. Thus, one or more embodiments can include a chord grid selector subroutine, processor, and/or method that allows the user to specify the desired chord and grid settings or to choose the desired chord and grid settings from a library. Input/output control of the chord grid selector subroutine, processor, and/or method can be performed through a chord grid selector menu, which provides a convenient user-interface. The chord and grid setting can be categorized in a library such that a single user selection on the chord grid selector menu specifies all necessary chord and grid settings, for example the desired tuning and the number of strings. According to one or more embodiments, once the user specifies or selects the chord grid settings and optionally a root note, an appropriate chord grid is ready to be inserted into classical notation. Selection of a desired tuning can be made by the user. For example, a user can select a desired tuning from a drop down menu within the chord grid selector menu, as shown in FIG. 13.

Figure 14:
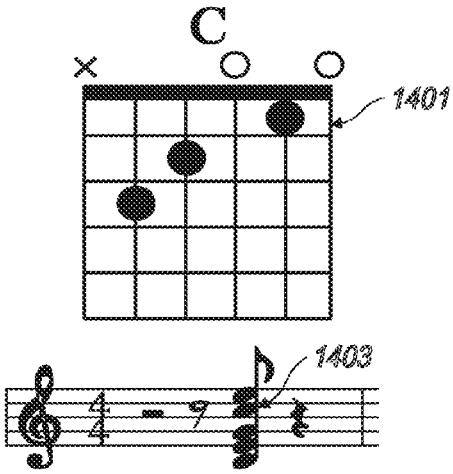
FIG. 14 depicts a schematic of a chord grid inserted into classical musical notation in accordance with an exemplary embodiment.

FIG. 14 depicts a schematic of a chord grid inserted into classical musical notation in accordance with an exemplary embodiment. Based on the selection of a tuning, and a root note, an appropriate chord grid 1401 can be inserted into classical notation 1402 not on fig, as shown in FIG. 14. The insertion of the chord grid 1401 can result in the insertion of a chord 1403 written in classical musical notation.

One or more embodiments can allow a user to specify a tuning, and one or more notes of the chord 1403, including a root note. Based on these user inputs, the DAW can generate and insert the appropriate chord grid showing the fingering. The fingering shown in the inserted chord grid can be determined based on a user specified difficulty level. For example, an amateur guitarist may prefer a score showing the easiest fingerings available, or a guitarist attempting to improve or to learn may prefer more difficult fingerings.

According to some embodiments, a chord naming algorithm can be used to generate chord names and/or chord fingerings. Chord names and chord fingerings can be generated based on a combination of: (1) a chord root note, and/or a position for one or more fingering dots, and (2) an instrument type, and/or a tuning for one or more strings. The tuning determines the pitches of the open strings. The pitches of the open strings and the position of the fingering dots determine the notes of the chord. The root note of the chord can be chosen in a popup button. The name of the chord can be derived by analyzing the interval (i.e., the distance in half note steps) of the chord notes in relation to the root note. According to common naming rules the name of the chord can then be generated. The name can include a root note name, a basic chord name, and/or an options name. The root note name can be a common name for the root note, for example, c, d, e, f, g, b. The alphanumerical representations can differ in different languages and musical traditions, for example, in German h could be used according to program preferences.

The basic chord name (e.g. major, minor, augmented, diminished, sus 4, sus 2, drone) can be chosen by analyzing the occurrence of intervals of 2, 3, 4, 5 half notes steps and of 6, 7, 8 half note steps. By way of a non-limiting example, an interval analysis can include one or more of the following commands, which can be performed by the computer 102, e.g., first processor. If the chord contains the intervals of 4 half note steps and 8 half note steps and not 7 half notes steps, a basic chord name of 'augmented' can be chosen. If the chord contains the intervals of 4 half note steps, a basic chord name of 'major' can be chosen. If the chord contains the intervals of 3 half note steps and 6 half note steps and not 7 half notes steps and not 10 half note steps, a basic chord name of 'diminished' can be chosen. If the chord contains the intervals of 3 half note steps and 7 half note steps, a basic chord name of 'minor' can be chosen. If the chord contains the intervals of 3 half note steps and not 7 half note steps and not 8 half note steps, a basic chord name of 'minor' can be chosen. If the chord contains the intervals of 5 half note steps and 7 half note steps, a basic chord name of 'sus 4' can be chosen. If the chord contains the intervals of 2 half note steps and 7 half note steps, a basic chord name of 'sus 4' can be chosen. If the chord contains the intervals of 7 half note steps, a basic chord name of 'drone' can be chosen. If the chord contains the intervals of 7 half note steps and 12 half note steps, a basic chord name of 'drone' can be chosen.

The options name can represent additional notes in a chord, e.g. "7," or "b9," etc. According to some embodiments, a list of all contained intervals measured in half note steps can be generated and sorted according to common musical naming rules. By way of a non-limiting example, an interval of 9 half note steps, i.e., a major 6, can be shown as '13' instead of '6', and an interval of 5 half note steps, i.e., a fourth, can be shown as '11' instead of '4,' in case an interval of 3 or 4 half notes steps is present.

The basic chord name and the options name can be ordered according to one or more musical naming rules for chords. By way of a non-limiting example, if the basic chord names are 'sus 4' or 'sus 2,' the basic chord name can be displayed after the options name (e.g. '7 sus 4' can be used instead of 'sus 4 7') to adhere to one or more musical naming rules.

After chord grid settings have been established, one or more embodiments can allow the user to drag a desired chord grid to a score or to insert the desired chord grid into the score with a pencil tool. The score can be written in classical musical notation or can be written in string-instrument tablature. Upon inserting the desired chord grid to the score, a chord grid library can be displayed.

The chord grid library can be opened in a modal or non-modal form. A modal window can block all other workflow in the program until the modal window is closed. A non-modal window can be a standalone window, and therefore, can include a navigational tab to allow users to select particular tunings, and chord grid libraries. The distinction between a modal and a non-modal format is primarily a workflow distinction. The functions of selecting and editing chord grids according to various embodiments can be the same regardless of whether the chord grid library is operated in modal or non-modal form.

Figure 15:
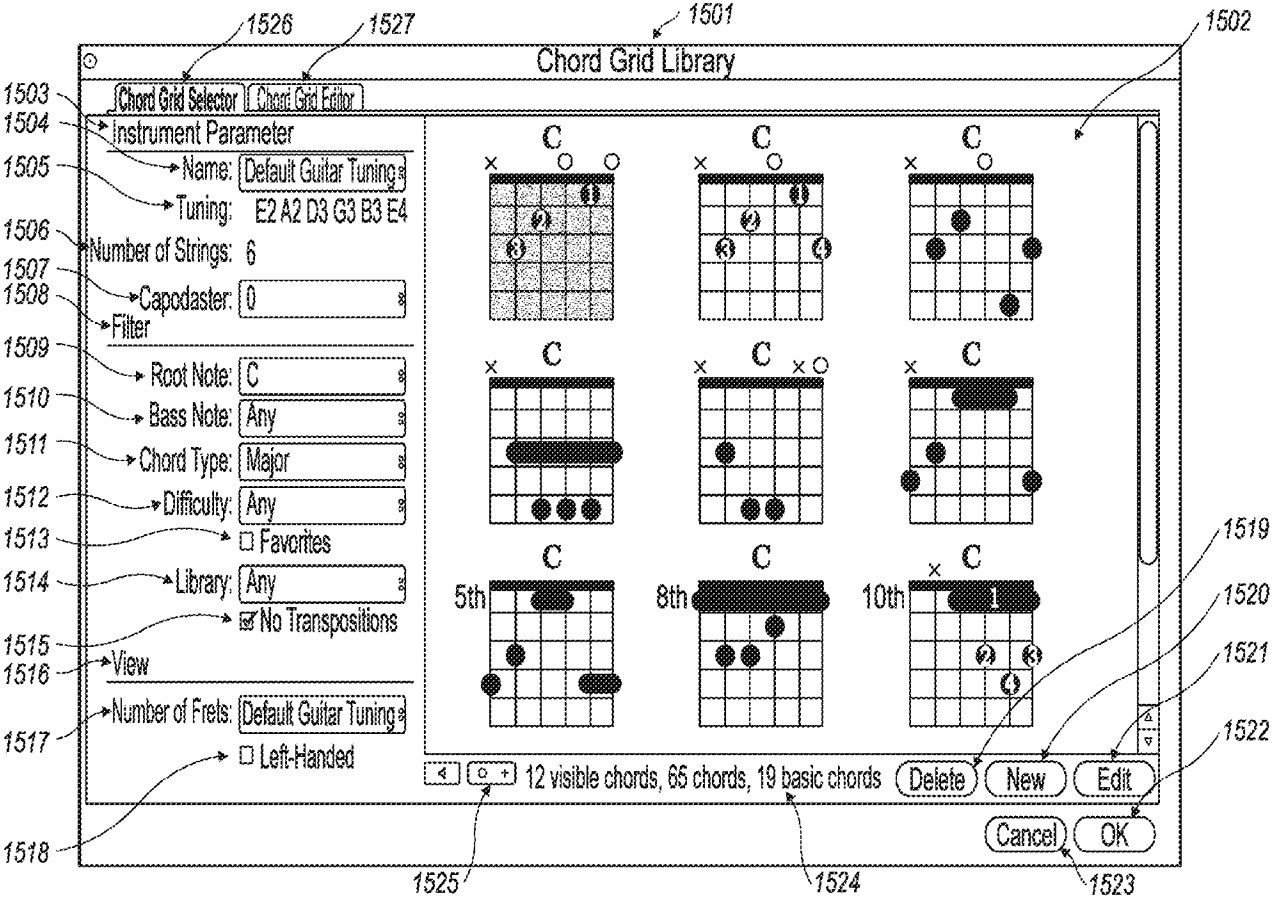
FIG. 15 depicts a screenshot of a chord grid library window functioning as a chord grid selector in accordance with an exemplary embodiment.
Figure 24:
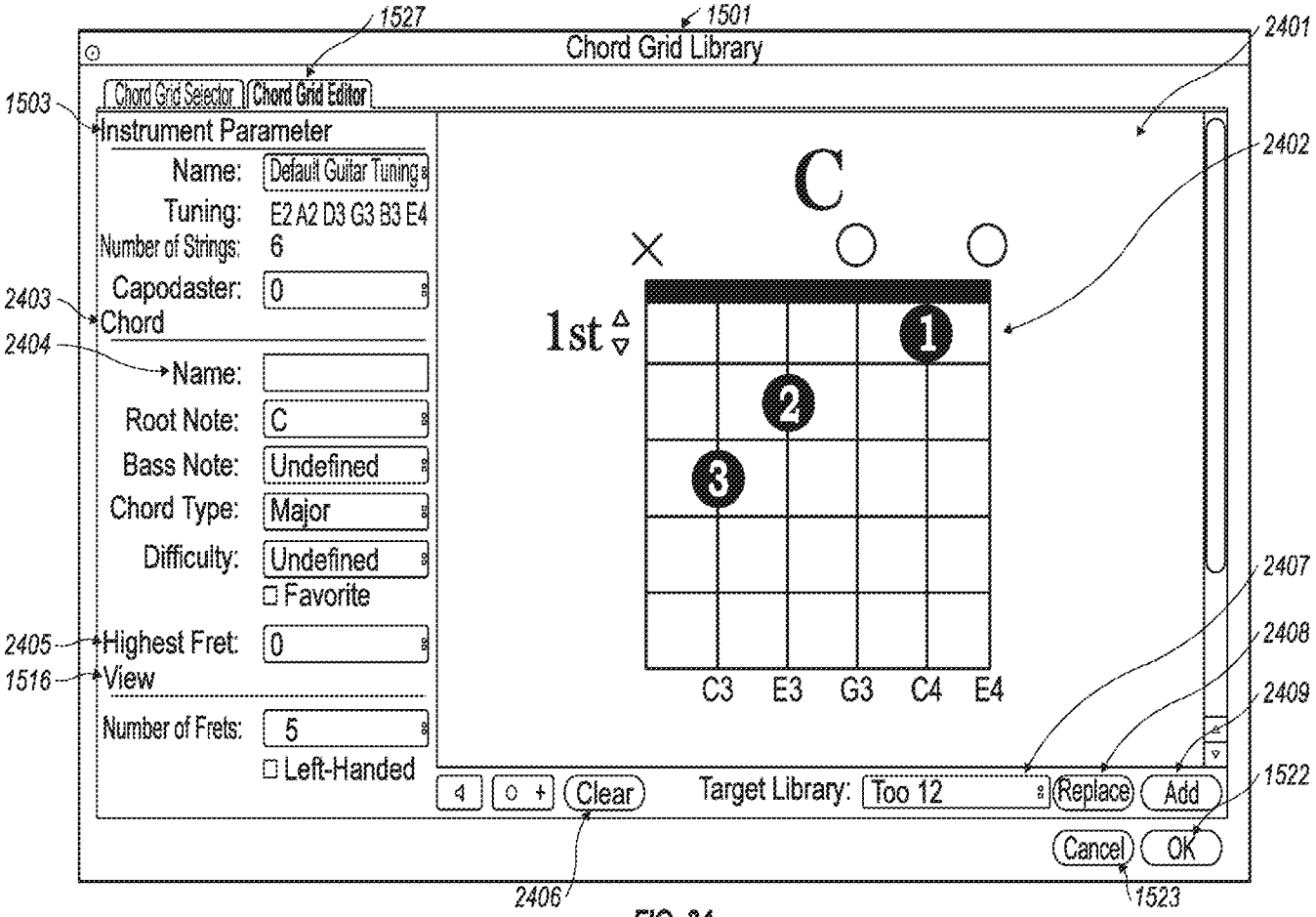
FIG. 24 depicts a screenshot of a chord grid library window functioning as a chord grid editor in accordance with an exemplary embodiment.

FIG. 15 depicts a screenshot of a chord grid library window functioning as a chord grid selector in accordance with an exemplary embodiment. More specifically, chord grid library window 1501 is shown in FIG. 15. The chord grid library window 1501 is a modal window. An illustration of a chord grid library window in non-modal form is shown in FIG. 24. A difference between the modal and non-modal forms is the presence of an instrument editor tab in the non-modal form, which provides convenient navigation between tunings and libraries of chords, thereby allowing the chord grid library window to function as a standalone. The non-modal chord grid library window can open directly to the instrument editor tab, while the modal chord grid library window opens directly to the chord grid selector tab.

Regardless of whether the chord grid library window 1501 is operating in modal or non-modal form, when the chord grid selector tab 1526 is selected, one or more chord grids 1502 for a particular root note can be displayed. The root note and other parameters can be adjustable from within the chord grid library window 1501. One or more of the chord grids 1502 can be selectable by the user. The viewable features of a selected chord grid or of selected chord grids can be altered to help a user determine which grid or grids are selected. For example, a selected chord grid can be displayed in a different color, in a different size, or with an indicator.

The chord grid library window 1501 can include an instrument parameter menu 1503. The instrument parameter menu can include one or more of the following settings: an instrument name setting 1504, a tuning setting 1505, a number of strings setting 1506, and a capodaster setting 1507. The instrument parameters can be determined by a staff style selected or automatically determined based on the tablature notation or classical notation selected. The content shown in the instrument parameter menu 1503 can be determined by settings specified in a filter menu 1508 and/or in a view menu 1516.

The instrument name setting 1504 can allow a user to select a particular instrument. The instrument can include, for example but not limitation, a Guitar, a lute, an Appalachian dulcimer, an Autoharp, a Bağlama, a Bajo sexto, a Balalaika, a Bandura, a Bandurria, a Banjo, a Barbat, a Begena, a Bordonua, a Bouzouki, a Bugarija, a Buzuq, a Cavaquinho, a Çeng, a Charango, a Chitarra battente, a Chitarrone, a Cittern, a Cuatro, a Cuatro, a Cümüş, a Đàn bầu, a Đàn nguyệt, a Đàn tranh, a Đàn tỳ bà, a Diddley bow, a Dombra, a Domra, a Doshpuluur, a Dutar, a Duxianqin, an Ektara, an Electric bass, an Electric upright bass, a Gayageum, a Geomungo, a Gottuvadhyam, a Gravikord, a Guitar, an Acoustic bass guitar, a Baritone guitar, a Bass guitar, a Cigar box guitar, an Electric guitar, a Harp guitar, a Resonator guitar, a Seven-string guitar, a twelve-string guitar, a Tailed bridge guitar, a Tenor guitar, a Guitarrón, a Gusli, a Guqin, a Guzheng, a Harp, an Electric harp, a Harpsichord, an Irish bouzouki, a Kacapi, a Kantele, a Kanun, a Kobza, a Konghou, a Kontigi, a Kora, a Koto, a Krar, a Kutiyapi, a Langeleik, a Laud, a Liuqin, a Lute, an Archlute, a Theorbo, a Lyre, a Mandolin, a Mandala, an Octave mandala, a Mandocello, a Mando-banjo, a Mohan veena, a Monochord, a Musical bow, a Nyatiti, an Oud, a Pandura, a Pipa, a Portuguese guitar, a Psaltery, a Qanūm/kanun, a Qinqin, a Ruan, a Requinto, a Rote, a Rubab, a Rudra veena, a Sallaneh, a Sanxian, a Saraswati veena, a Šargija, a Sarod, a Saung, a Saz, a Shamisen, a Sitar, a Tambura, a Tamburitza, a Tanbur, a Tar, a Tea chest bass, a Tiple, a Tiple, a Torban, a Tres, a Tricordia, a Ukulele, a Valiha, a Veena, a Vichitra veena, a Vihuela, a Yueqin, a Zhongruan, a Zhu, and a Zither. Selecting the instrument can automatically determine a tuning for the tuning setting 1505 and/or a number of strings for the number of strings setting 1506. The capodaster setting 1507 can allow for correct naming of chord grids when a capo is used at a certain fret. The naming can be determined based on a database of known chord grids. Alternatively, the naming can be determined based on an algorithm that applies a naming convention to the notes that would be sounded according to a particular fingering displayed on a chord grid. The default setting for the capodaster setting 1507 can be "0," which can correspond to no capo.

The chord grid library window 1501 can include a filter menu 1508. The filter menu can allow for filtering of chord grid content within the chord grid library window 1501. For example, the filter menu can allow a user to view all "C" chords or all "minor" chords. The filter menu can include one or more of the following settings: a root note setting 1509, a bass note setting 1510, a chord type setting 1511, a difficulty setting 1512, a favorites toggle setting 1513, a library setting 1514, and a no transpositions toggle setting 1515. All of these settings can be specified as "any" or "undefined" such that the filtering process does not include the setting as a filtering criterion.

The root note setting 1509 can allow a user to select or to specify a root note that can serve as the basis for generating a chord grid including fingering indications. Similarly, the bass note setting 1510 can allow a user to select or to specify a bass note that can serve as the basis for generating a chord grid including fingering indications. Both the root note setting 1509 and the bass note setting 1510 can include a listing of all the traditional music notes that can be represented by the first seven letters of the Latin alphabet (A, B, C, D, E, F and G), as well as representations of accidentals such as sharps and flats of musical notes.

The chord type setting 1511 can allow a user to select or to specify one or more chord types. For example, a user may select one or more chord types such as, major, minor, sus2, sus4, major 6, major 6 added 9, minor b6, minor 6, minor 6 added 9, major 7, major 7 b5, major 7 b9, major 7 #9, major 7 b5 #9, major j7, major 7, and major j7.

The difficulty setting 1512 can be an attribute that can be set during the authoring/creation process of chord grids or even afterwards for already created chord grids. The difficulty setting can allow a user to provide a ranking or rating of the difficulty associated with playing a particular chord. The ranking or rating can be in a format, such as an alphanumerical designation, colors, and/or shapes. Difficulty ratings can be provided for all chords preloaded into the system. The preloaded difficulty ratings can be edited by the user. In one or more embodiments, upon creation of a new chord, a difficulty rating can be automatically generated based on any number of criteria. One difficulty-rating criterion can be the number of finger positions required to form the chord. For example, if a chord requiring only one finger to form could be rated as being less difficult than a chord that requires two, three, four, or five fingers to form. Another difficulty-rating criterion can be the distance between finger positions. Another difficulty-rating criterion can be the presence or absence of a bane, i.e., where one or more fingers are used to press down multiple strings across the fingerboard. For example, chords that require more strings to be depressed to form the bane can be rated as being more or less difficult. Another difficulty-rating criterion can be the position of the chord on the fingerboard. For example, chords further down the fingerboard, i.e. further away from the top of the instrument's neck, can be rated as being more or less difficult.

Difficulty factors can be generated for individual chords. For example, the difficulty of an individual chord can be rated based on one or more of the following considerations: the difference between the lowest and the highest used fret (generally, the larger the difference, the further the player must stretch, and the more difficult the chord); the number of strings used in a bane (generally, the more strings used to form a barré, the more difficult the chord); the usage of a second bane (generally, each additional bane makes the chord more difficult); the presence of silent middle strings, i.e., strings in the middle of the chord which are not sounded when the chord is played (generally, the presence of silent middle strings makes the chord more difficult); the presence of lower fret numbers on higher strings (generally, lower fret numbers on higher strings are more complicated, because the higher string could be accidently muted); the relative positions of fingers, for example, a chord might require two or more fingers to be positioned along the same fret on different strings (generally, chords that require closely clustered finger positions or widely separated finger positions are more difficult than chords that allow fingers to be more evenly or naturally spaced); the difference between the position the musicians fingers must take to form the chord and the natural position of hand (generally, the greater the difference, the harder the chord); the fret number (generally, chords positioned on higher frets, especially with close grips, are more difficult); the presence of stretched grips on lower frets (generally, on lower frets stretched grips are more difficult); and the grips on frets above corpus cutaway (generally, grips on frets above corpus cutaway are more difficult). Some embodiments can employ a lookup table to determine the difficulty for special cases. In some embodiments, grips or chords with the same hand shape as in the library are assigned the same difficulty. "Hand shape" refers to the relative position of the fingers when forming the chord.

According to one or more embodiments, a difficulty rating can be determined for transitioning between chords inserted into a score. A comparison can be made between the fingering required for a musician to form a first chord and the fingering required for a musician to form a second chord. The difficulty rating can be based on the degree to which the fingering position must be changed to transition from the first chord to the second chord. For example, a long shift down the fingerboard can be reflected as a higher difficulty rating. One or more embodiments can compare the number of fingers needed to form each chord. The comparison of consecutive chords can be based on the total amount of finger movement needed for a musician to transition from the first chord to the second chord. Additionally or alternatively, the difficulty rating can be based on the timing between chords imposed by the musical score. For example, a quick transition between two easy to form chords that are close together can be more difficult than a slow transition between two more difficult chords that are far apart on the fingerboard.

Difficulty factors can be generated for two consecutive chords in a score. For example, difficulty factors can be generated for consecutive chords based on one or more of the following factors: the movement of the hand measured in frets between the chords, and the change of the hand shape between the chords, i.e., the difference between relative positions of fingers of first chord to relative position of fingers of second chords.

Alternate chords can be recommended based on the difficulty factors. In some embodiments, alternate chords are selected from all chords having the same name as the chord to be replaced based on a comparison of the difficulty factors of the chords. Alternate chords can be recommended according to an alternate chord ranking. For example, a chord might receive a malus and be less recommendable, due to missing options, complexity, and/or a high difficulty rating. For example, a chord with optional fingerings available can be recommended over a chord without optional fingerings. In some embodiments an easier chord using fewer optional notes is recommended (e.g. a Cm7 instead of a Cm7/9).

Scores can include one or more chord progressions. A chord progression is a series of chords to be played in sequence. One or more alternate chords can be recommended for a chord progression. For example, alternate chords can be chosen by minimizing movement of hand measured in frets between chords, and/or by minimizing the movement of hand shape for consecutive chords or a sequence of consecutive chords. Some embodiments analyze a chord progression and determine a difficulty factor for the chord progression. The difficulty factor can be based on the sum of difficulties for transitioning between consecutive chords and the sum difficulties for each individual chord in the chord progression. Since, in some cases, it may be possible to reduce the difficulty of a given chord progression by playing the chord progression in a different key and/or tuning, some embodiments compare the overall difficulty factor for a chord progression with difficulty factors for the same chord progression in a different key and/or in a different tuning. An alternate key and/or tuning can be recommended to provide a more or less difficult chord progression. The chords grids for the chord progression in an alternate key and/or tuning can be generated and can replace the original chord progression in the score.

The favorites toggle setting 1513 can allow the user to mark a particular chord as a favorite. This allows the user to have quick access to chords that are used frequently.

The library setting 1514 can allow a user to specify or to select a chord grid library for a particular instrument or tuning. As a default, the library setting can be set to "all," so as to show all available chord grid libraries for the selected instrument or tuning.

Figure 16:
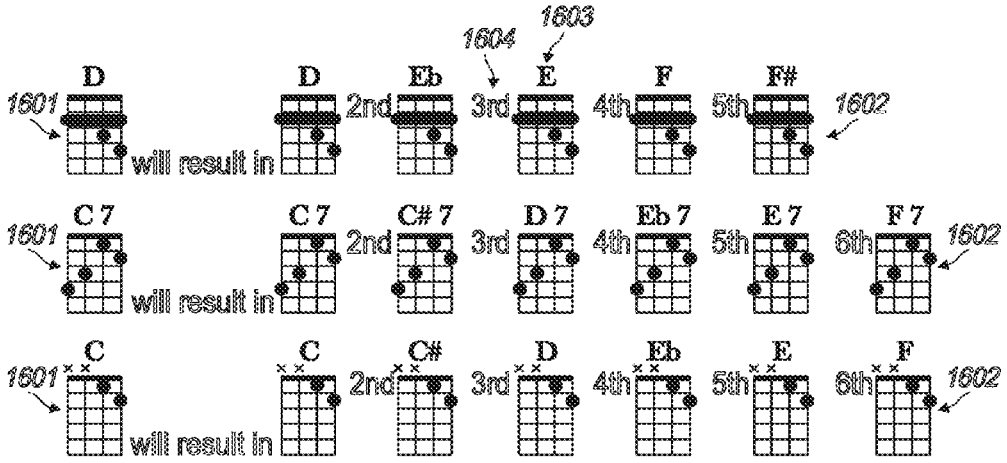
FIG. 16 depicts schematics of examples of chord series generated from a base chord in accordance with an exemplary embodiment.

The no transpositions toggle setting 1515 can allow a user to view or not to view transpositions for certain chords. Transpositions can be generated for chords meeting one or more preconditions. A transposition can be generated, if the chord is formed with a full barré. A transposition can be generated, if the chord does not contain any open strings. A full bane is a type of chord where one or more fingers are used to press down all strings across the fingerboard. An open string is any string that is sounded without being depressed by the musician onto the fingerboard. If a chord meets the preconditions, and if the user deselects the no transpositions toggle setting 1515, then a series of chords can be displayed. The displayed series of chords can have identical fingerings, but can be shifted along the fingerboard to lower or higher frets. The series of chords can, therefore, include a fret number indication. The series of chords can include chord names, which can be generated, for example, by comparing the chord with a database of known chords, or by using an algorithm to apply a chord naming convention to the notes played according to the chord's fingering. FIG. 16 depicts schematics of examples of chord series generated from a base chord in accordance with an exemplary embodiment. More specifically, FIG. 16 shows several examples of chord series 1602 transposed from a base chord 1601. The chords in the chord series include a chord name 1603 and a fret number indication 1604.

The chord grid library window 1501 can include a view menu 1516. The view menu can include one or more of the following settings: a number of frets setting 1517 and a left-handed toggle setting 1518. The number of frets setting 1517 can filter the displayed chord grids based on the number of frets displayed. The left-handed toggle setting 1518 can provide a mirrored chord grid view for left-handed musicians.

The chord grid library window can include a number of features for creating, editing, and/or manipulating chord grid libraries. For example, the chord grid library window 1501 can include one or more of the following buttons: a delete button 1519, a new button 1520, an edit button 1521, an ok button 1522, and a cancel button 1523. The delete button 1519 can allow the user to delete a chord grid. This feature is useful for deleting non-factory chord grids, dupes, and/or mistakes. The new button 1520 can allow a user to open the chord grid editor tab 1527 showing an empty chord grid as a starting point to create a new chord grid with fingering. The edit button 1521 can allow a user to open the chord grid editor tab 1527 showing the selected chord grid. The ok button 1522 can close the chord grid library window 1501 and can insert the last edited or selected chord grid into a score. The cancel button 1523 can close the chord grid library window and can revert all changes.

According to certain embodiments, libraries can be created, stored, and/or retrieved for a new tuning or instrument. A library can include a name to identify the library for the user, one or more tunings, one or more untransposed chords, optional data to speed up search processes, one or more optional flags to mark the library as read only (for example, to avoid editing of factory libraries by the user), and/or other information for managing the library. An untransposed chord can include a representation of the elements of a chord grid, a range within which the chord can be transposed, a difficulty level, a root note, and/or an optional bass note.

Some embodiments use software on the computer 102, e.g., first processor, to store the library in one or more files. For example, an OS X (™ Apple, Inc.) package can be used to store the library in one or more files. Some embodiments use an NSData object to store the library information in one or more files.

Some embodiments automatically generate a library. The library can be generated by using a list of all possible hand shapes and chord names for a tuning. A determination can then be made regarding the usability and/or desirability of individual chords.

The chord grid library window 1501 can include an information display 1524 that displays information about visible chord grids 1502 within the chord grid selector tab 1526. The information displayed in the information display 1524 can include, but is not limited to the total number of visible chords, the total number of chords, and the total number of basic chords. The number of chords generated can be related to the settings selected in the filter menu 1508 and the setting selected in the instrument parameter menu 1503.

Figure 17:
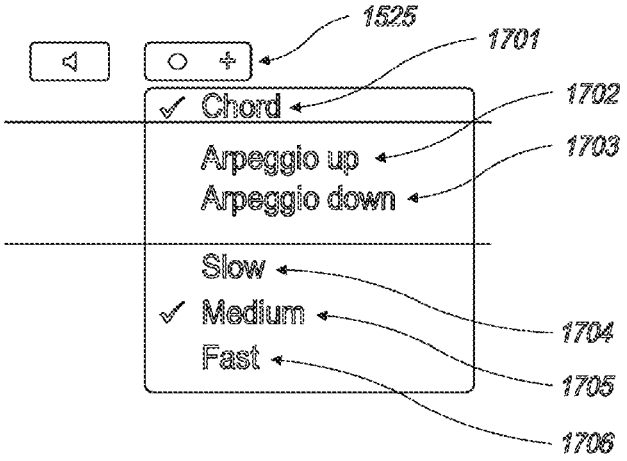
FIG. 17 depicts a screenshot of a playback menu in accordance with an exemplary embodiment.

The chord grid library window 1501 can include a playback button/drop-down menu 1525. FIG. 17 depicts a screenshot of a playback menu in accordance with an exemplary embodiment. An extended play back drop-down menu 1525 is shown in FIG. 17. By clicking button 1525 a user is able to listen to a selected chord grid or to multiple selected chord grids. By extending the drop-down menu 1525, a user can specify various playback features, such as what will be played back and at what speed. For example, by selecting chord item 1701, a user can specify that the chord defined by the selected chord grid will be strummed or sounded with all notes played simultaneously. By selecting Arpeggio up item 1702 or Arpeggio down item 1703, a user can specify that an arpeggio rather than a chord will be played. The arpeggio can be played from the lowest note to the highest note of the chord or from the highest note to the lowest note of the chord. By selecting slow item 1704, medium item 1705, or fast item 1706 a user can specify a relative speed at which the chord or arpeggio will be played. The playback button/drop-down menu 1525 can include an item or command that enables a user to select an instrument to voice the chord or arpeggio. The default instrument can be an acoustic guitar, for example.

Figure 18:
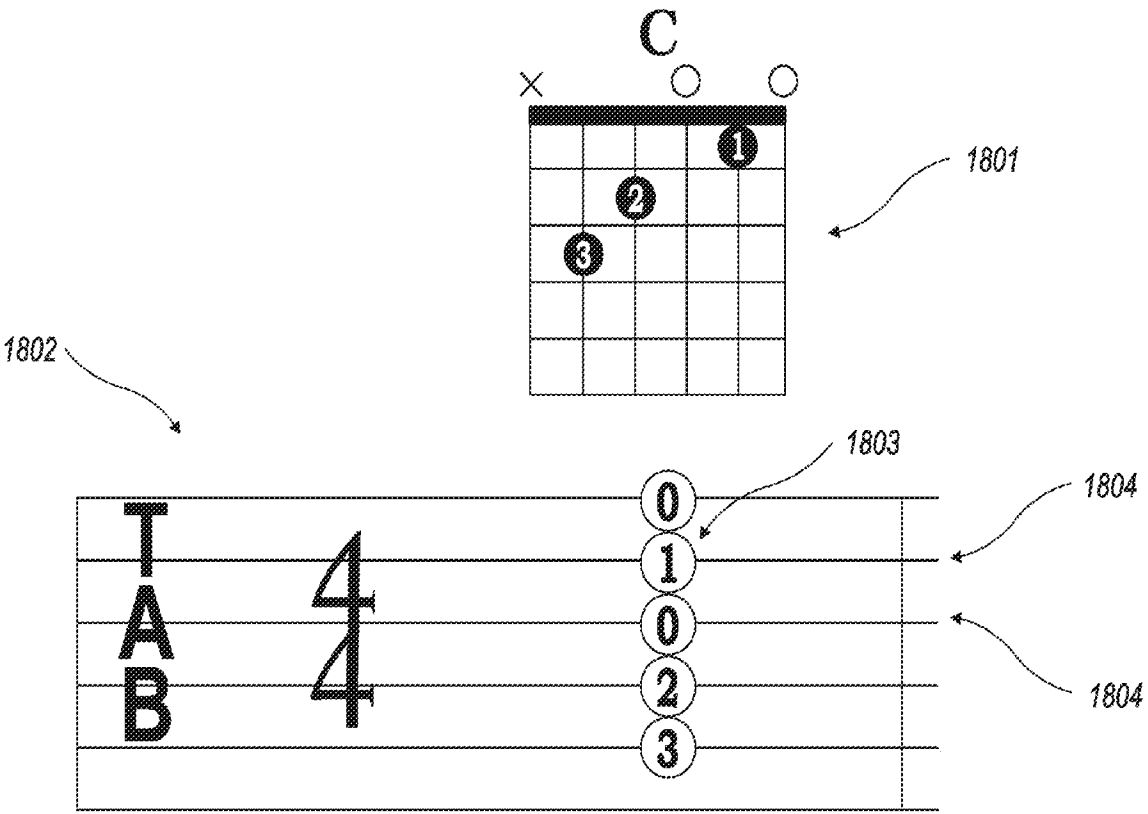
FIG. 18 depicts a schematic of a chord grid inserted into a tablature score in accordance with an exemplary embodiment.

Once the user selects the desired chord from the one or more chords 1502, for example, by clicking the desired chord and then clicking the ok button 1522, the chord can be inserted into a score. FIG. 18 depicts a schematic of a chord grid inserted into a tablature score in accordance with an exemplary embodiment. More specifically, FIG. 18 shows a chord 1801 selected from among the chords 1502 from FIG. 15 inserted into a guitar tablature score 1802. A tablature entry 1803 can be generated based on the chord 1801. A chord name 1001 for an F-minor chord is shown in FIG. 10.

One or more embodiments can allow a user to click fret lines 1804 on the tablature score 1802 to create the tablature entry 1803. Based on these user inputs, one or more embodiments can generate and insert the appropriate chord grid showing the fingering specified by the tablature entry 1803.

One or more embodiments can provide additional user-interface functionality once a chord is inserted into a score. Double clicking on an already inserted chord grid, can open an inspector window and/or the chord grid library window, for example, the modal chord grid library window, to allow the user to replace the selected chord with an alternative chord, perhaps, providing a less difficult or more challenging fingering, or a different voicing of the chord. One or more embodiments provide a drag-copying subroutine, processor, and/or method and a drag-copying user-interface that allows the user to select and insert one or more previously inserted chords without having to initialize the chord grid library menu. This feature can be useful, for example, when a user is writing a song containing only a limited number of different chords. For example, a rock song can include as few as 2-8 different chord grids.

Figure 19:
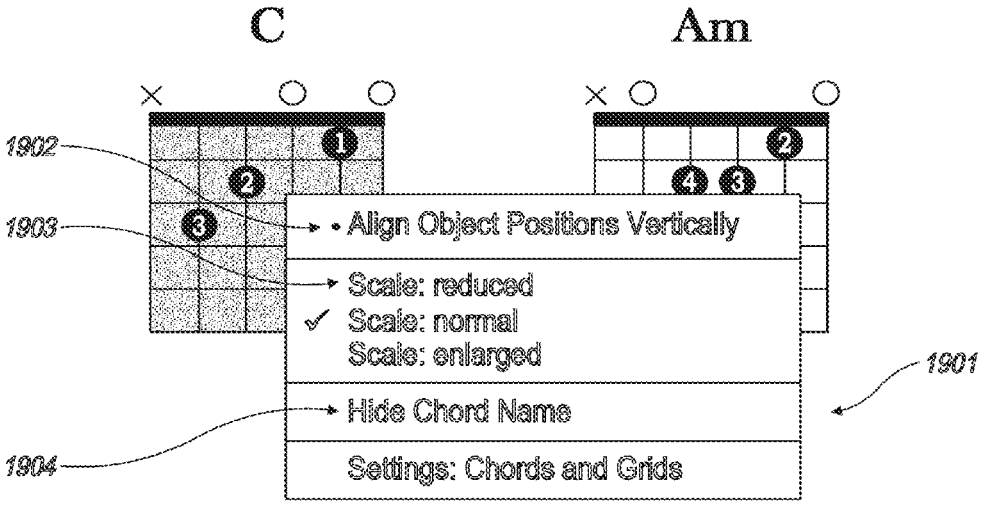
FIG. 19 depicts a screenshot of a contextual menu associated with and accessible from a chord grid in accordance with an exemplary embodiment.

The DAW user-interface can include a contextual menu, accessible by clicking a chord grid in a score. FIG. 19 depicts a screenshot of a contextual menu associated with and accessible from a chord grid in accordance with an exemplary embodiment. More specifically, a contextual menu 1901 is illustrated in FIG. 19. The contextual menu can include an align object positions vertically setting 1902 that allows a user to align selected chord grids vertically.

Figure 20:
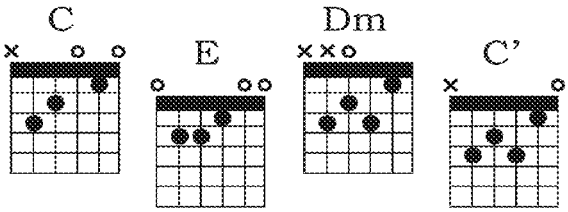
FIG. 20 depicts a schematic of a series of misaligned chord grids in accordance with an exemplary embodiment.
Figure 21:
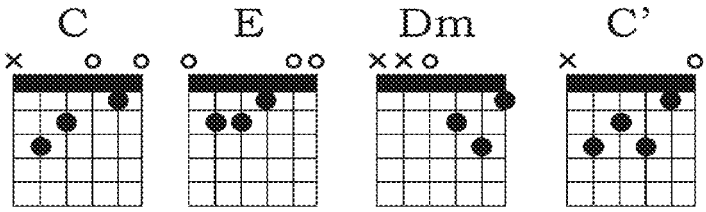
FIG. 21 depicts a schematic of a series of aligned chord grids in accordance with an exemplary embodiment.
Figure 22:
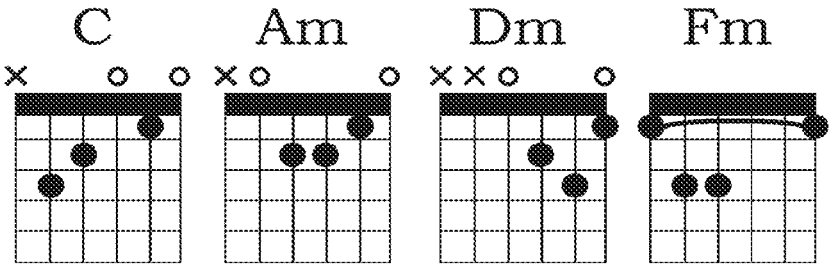
FIG. 22 depicts a schematic of a series of chord grids including chord names in accordance with an exemplary embodiment.
Figure 23:
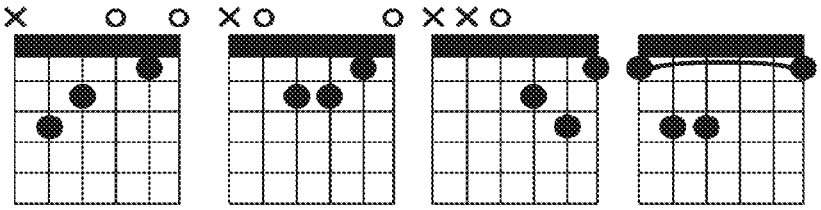
FIG. 23 depicts a schematic of a series of chord grids without chord names in accordance with an exemplary embodiment.

Unaligned chord grids are shown in FIG. 20, and aligned chord grids are shown in FIG. 21. In some scores chords may need to be at different vertical heights, for example, to provide space for high pitched notes to be notated. The contextual menu 1901 can include a chord grid scale setting 1903 that allows a user to adjust the size of the selected chord grid or grids. The contextual menu 1901 can include a hide chord name toggle setting 1904 that allows a user to specify whether the chord name is displayed above the chord grid. FIG. 22 shows a series of chord grids with chord names displayed. FIG. 23 shows a series of chord grids without chord names displayed.

One or more embodiments can include a chord grid editor subroutine, processor, and/or method that allows the user to create and/or edit chords. Input/output control of the chord grid editor subroutine, processor, and/or method can be performed through the modal or non-modal chord grid library, which provides a convenient user interface. The chord grid editor tab 1527 can open if a user takes any of the following actions within the chord grid library window: (1) the user double clicks on a displayed chord grid 1502; (2) the user clicks the edit button 1521, (3) the user clicks the new button 1520, or (4) if the user clicks on the chord grid editor tab itself.

FIG. 24 depicts a screenshot of a chord grid library window functioning as a chord grid editor in accordance with an exemplary embodiment. More specifically, FIG. 24 shows the chord grid library window 1501, as shown in FIG. 15, but with the chord grid editor tab 1527 selected, thereby displaying a chord grid editor interface 2401 showing a single chord grid 2402 ready for editing. The chord grid editor interface 2401 can be accessible from a modal chord grid library window or a modal chord grid library window. The instrument parameter menu 1503 and the view menu 1516 can remain unchanged upon selecting the chord grid editor tab. The filter menu 1508, however, can be replaced by chord menu 2403. The chord menu 2403 can include the same settings as the filtering menu 1508, except that the library setting 1514 and the no transpositions setting 1515 are replaced by a name setting 2404, and a highest fret setting 2405. The name setting can display and/or allows a user to assign a name to the chord 2402.

In one or more embodiments, the chord grid editor can include one or more features to enable a user to insert an edited chord grid into a library, to replace a chord grid in a library with an edited chord, and/or to insert an edited chord grid into a score. For example, when the chord grid editor tab 1527 is selected, the chord grid library window 1501 can include a clear button 2406, a target library selector 2407, a replace button 2408, and an add button 2409. The clear button 2406 clears the chord 2402 from the chord grid editor interface 2401. The target library selector 2407 can allow a user to specify a library of chords to which the edited chord can be added. The add button 2409 can allow a user to add an edited chord as a variation in addition to the original chord grid to the specified library. Alternatively, the user can click the replace button 2408 and allow the edited chord to replace the chord 2402, which was previously part of a library of chords. In certain embodiments, the replace button 2408 is active only if the user is editing a chord grid from a library. The cancel button 1523 can revert all changes. According to one or more embodiments, upon clicking the add button 2409 or the replace button 2408, the view changes back to the chord grid selector. The ok button 1522 can insert either the chord 2402 or a chord as edited by the user directly into a score, and can then display the score. When the chord grid editor tab 1527 is selected, the chord grid library window 1501 can include the same playback functionality for chord grids as described above with respect to the chord grid selector interface.

Figure 25:
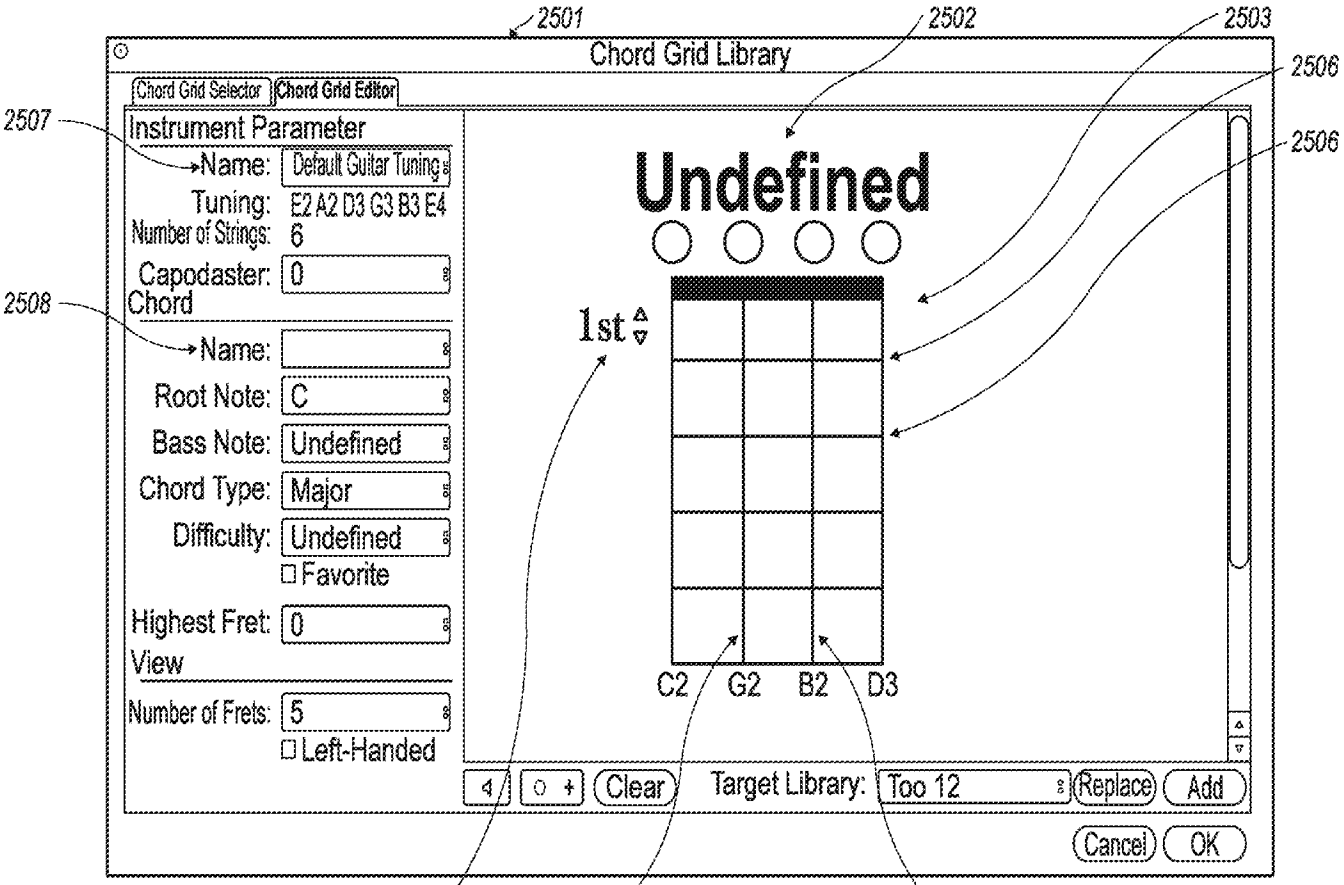
FIG. 25 depicts a screenshot of a chord grid editor displaying an undefined chord grid in accordance with an exemplary embodiment.

FIG. 25 depicts a screenshot of a chord grid editor displaying an undefined chord grid in accordance with an exemplary embodiment. As illustrated in FIG. 25, when the user specifies a name 2507 for an instrument, the DAW can automatically specify a tuning and/or a number of strings based on an existing chord grid library associated with the instrument. A chord grid editor interface 2501, can display a chord grid 2503, having a chord name 2502. Before the user selects or specifies a root note, the chord name 2502 can be "Undefined." The chord grid 2503 can include a fret number indication 2504, which can default to the first fret, for example. The chord grid 2503 can include a user specifiable number of strings 2505 and a user specifiable number of frets 2506. By specifying a root note 2508, chord name 2502 can be updated. For example, the chord name 2502 can be updated based on the root note 2508, and the specified tuning of the strings. The chord name can be retrieved from a database of stored chord names. Alternatively, the chord name can be generated based on a naming convention. The naming convention can take into consideration the notes represented by the fingering shown on the chord grid 2503.

The user can be allowed to add fingerings to the chord grid 2503. In one or more embodiments, chord grid editor interface 2501 can include an automatic chord detection subroutine, processor, and/or method. The automatic chord detection subroutine, processor, and/or method can update the chord grid 2503, when the user clicks on a string 2505 between two frets 2506 to show a fingering dot on the string and between the two frets. Each time a finger dot is added, the chord name 2502 can be updated, as already described.

Figure 26:
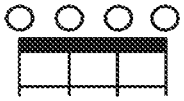
FIG. 26 depicts a schematic of a chord grid showing all strings in an open position in accordance with an exemplary embodiment.
Figure 27:
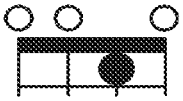
FIG. 27 depicts the chord grid of FIG. 26 with one fingering dot added in accordance with an exemplary embodiment.
Figure 28:
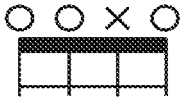
FIG. 28 depicts the chord grid of FIG. 26 or 27 with one string marked as being damped in accordance with an exemplary embodiment.

FIG. 26 depicts a schematic of a chord grid showing all strings in an open position in accordance with an exemplary embodiment. As a default, all strings of chord grid 2503 can be in the open position, as shown in FIG. 26. The strings in FIG. 26 are all marked with open string position indicators, which can be open circles or dots. FIG. 27 depicts the chord grid of FIG. 26 with one fingering dot added in accordance with an exemplary embodiment. Clicking on a string can add a fingering dot and can remove an open string indicator as shown in FIG. 27. Clicking on the fingering dot can remove the dot and returns the chord grid 2503 to a configuration where the string previously marked with the fingering dot is marked in an open position. FIG. 28 depicts the chord grid of FIG. 26 or 27 with one string marked as being damped in accordance with an exemplary embodiment. Clicking on an open string indicator can replace the open string indicator with a damped string indicator, which can be an "x," as shown in FIG. 28.

Figure 29:
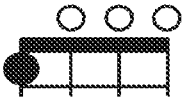
FIG. 29 depicts a schematic of a chord grid with one fingering dot in accordance with an exemplary embodiment.
Figure 30:
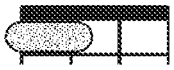
FIG. 30 depicts the chord grid of FIG. 29, where the fingering dot has been dragged to create a partial bane covering two strings in accordance with an exemplary embodiment.
Figure 31:
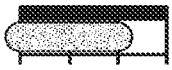
FIG. 31 depicts the chord grid of FIG. 29, where the fingering dot has been dragged to create a partial bane on three strings in accordance with an exemplary embodiment.
Figure 32:
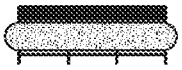
FIG. 32 depicts the chord grid of FIG. 29, where the fingering dot has been dragged to create a full bane on four strings in accordance with an exemplary embodiment.

FIG. 29 depicts a schematic of a chord grid with one fingering dot in accordance with an exemplary embodiment. When a fingering dot marks a string, as shown in FIG. 29, a user can click and drag the fingering dot across other strings between the same frets to create a barré as shown in FIGS. 30-32. A barré can cover any number of strings. FIG. 30 depicts the chord grid of FIG. 29, where the fingering dot has been dragged to create a partial barré covering two strings in accordance with an exemplary embodiment. FIG. 31 depicts the chord grid of FIG. 29, where the fingering dot has been dragged to create a partial barré on three strings in accordance with an exemplary embodiment. FIG. 32 depicts the chord grid of FIG. 29, where the fingering dot has been dragged to create a full barré on four strings in accordance with an exemplary embodiment.

Figure 33:
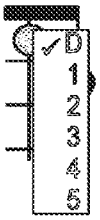
FIG. 33 depicts a screenshot of a contextual menu associated with and accessible from a fingering dot on a chord grid in accordance with an exemplary embodiment.
Figure 34:
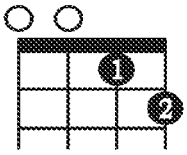
FIG. 34 depicts a schematic showing fingering numbers added to fingering dots on a chord grid in accordance with an exemplary embodiment.
Figure 35:
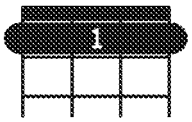
FIG. 35 depicts a schematic of a fingering number added to a barré in accordance with an exemplary embodiment.

FIG. 33 depicts a screenshot of a contextual menu associated with and accessible from a fingering dot on a chord grid in accordance with an exemplary embodiment. One or more embodiments can provide a system and a method to allow a user to add fingering numbers to fingering dots. The user can access a drop-down menu in the chord grid editor, as shown in FIG. 33. The drop-down menu can be accessed by right-clicking a finger dot or by clicking the dot and holding down a specified key on a keyboard, such as the control key. FIG. 34 depicts a schematic showing fingering numbers added to fingering dots on a chord grid in accordance with an exemplary embodiment. Fingering numbers can be added to a barré as shown in FIG. 35.

Figure 36:
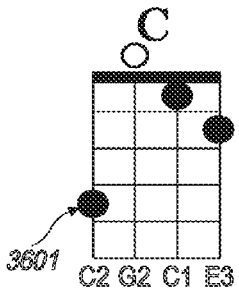
FIG. 36 depicts a schematic of a chord grid with finger dots representing a C-chord in accordance with an exemplary embodiment.
Figure 37:
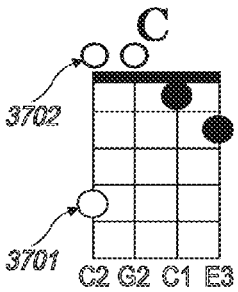
FIG. 37 depicts the chord grid of FIG. 36 with one fingering dot replaced by an optional fingering dot in accordance with an exemplary embodiment.
Figure 38:
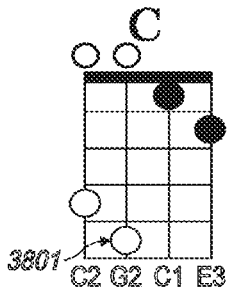
FIG. 38 depicts the chord grid of FIG. 37 with an optional fingering dot added in accordance with an exemplary embodiment.
Figure 39:
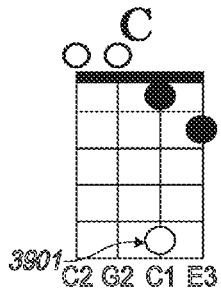
FIG. 39 depicts the chord grid of FIG. 36 with one fingering dot removed and one optional fingering dot added in accordance with an exemplary embodiment.

One or more embodiments can provide a system and a method to allow a user to insert optional fingering dots, or to designate already inserted fingering dots as optional. Optional fingering dots can be shown with an open circle as shown in FIGS. 37-39. When a user clicks a fingering dot while holding down a specified key on a keyboard, such as the "ALT" key, the fingering dot can be replaced with an optional fingering dot. For example, clicking fingering dot 3601 shown in FIG. 36, while holding down the "ALT" key on a keyboard can replace fingering dot 3601 with optional fingering dot 3701 as shown in FIG. 37. When a normal fingering dot is changed to an optional fingering dot an open string indicator 3702 can be added. The system and method according to one or more embodiments can allow optional fingering dots to be added to strings not already marked with a normal fingering dot. As shown in FIG. 38, optional fingering dot 3801 can be added, for example, by clicking the string while holding down the "ALT" key. When an optional fingering dot is added to an open string, as illustrated in FIG. 38, the open string indicator can remain unchanged. Finally, as shown in FIG. 39, an optional fingering dot 3901 can be added to a string already marked with a fingering dot, but at a different fret. The optional fingering dot can be added above or below the normal fingering dot. In one or more embodiments, when an optional fingering dot is added to a string already marked with a normal fingering dot, no open string indicator is added.

Figure 40:
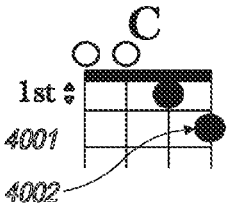
FIG. 40 depicts a schematic of a chord grid displaying a chord including multiple fingering dots in accordance with an exemplary embodiment.
Figure 41:
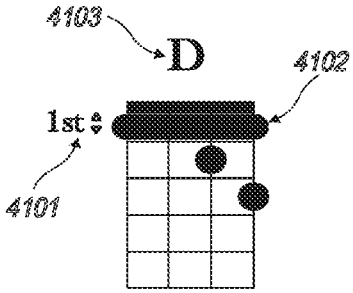
FIG. 41 depicts the chord grid of FIG. 40 where the fingering dots have been shifted to a lower fret and a barré has been added in accordance with an exemplary embodiment.
Figure 42:
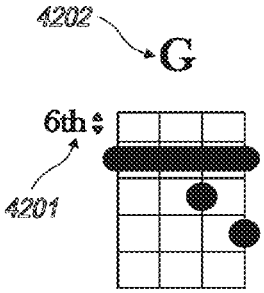
FIG. 42 depicts the chord grid of FIG. 41 shifted further down the fingerboard in accordance with an exemplary embodiment.

One or more embodiments can enable a user to create related chord girds on higher frets. Starting from a chord grid as illustrated in FIG. 40, a user can click and drag fingering dot 4001 and fingering dot 4002 to a lower fret on the same string. Then, as shown in FIG. 41, the user can add a barré 4102 on the fret directly above the repositioned fingering dots. The chord name 4103 can be updated automatically. To adjust the chord grid to arrive at a chord on a higher fret, the user can click on the fret number indicator 4101. Clicking on the fret number indicator 4101 can cause a drop down menu to appear, from which a user can select a desired fret number. The number of fret numbers listed can correspond to the number of frets on the selected instrument. Upon selecting a fret number, the fret number indicator can be updated, as shown in FIG. 42, where fret number indicator 4201 has been adjusted. Based on an adjustment to the fret number indicator chord name 4202 can be updated, or vice versa.

Figure 43:
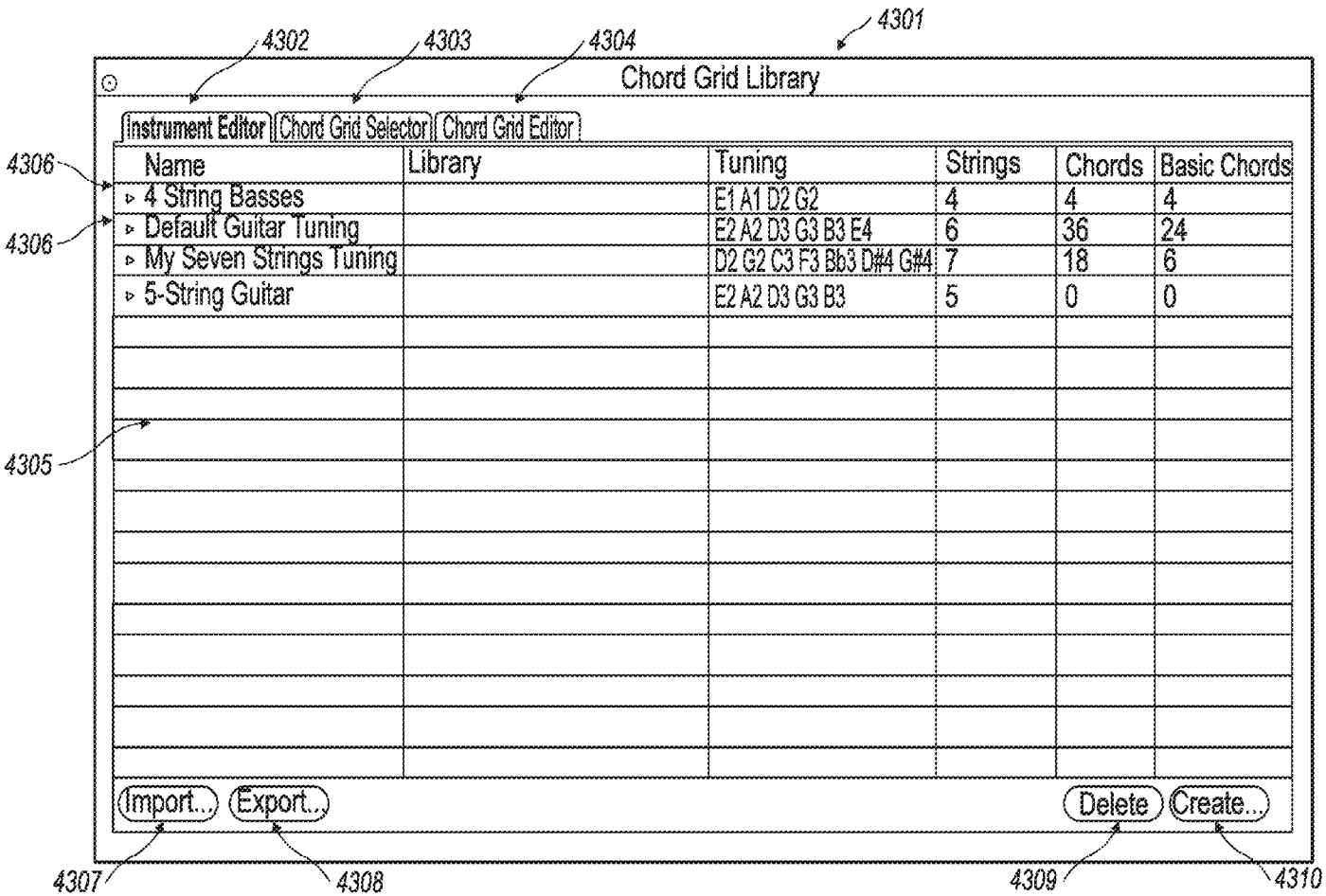
FIG. 43 depicts a screenshot of a multi-tab modal chord grid library window in accordance with an exemplary embodiment.

Again, according to one or more embodiments, the chord grid library can be opened in a modal or non-modal form. Reviewing existing chord grid libraries, importing or exporting libraries or creating a new library from scratch can be performed when the chord grid library is opened and operated in non-modal form. The non-modal chord grid library can be operable in a standalone mode. One or more embodiments provide convenient access to the non-modal chord grid library from the DAW user interface. For example, a user can be provided access to the non-modal chord grid library by a series of menu selections from within the DAW user-interface. Regardless of how a user accesses the non-modal chord grid library, certain embodiments open a three-tab non-modal chord grid library window. FIG. 43 depicts a screenshot of a multi-tab modal chord grid library window in accordance with an exemplary embodiment. More specifically, a three-tab non-modal chord grid library window 4301 is shown in FIG. 43. The non-modal chord grid library window 4301 can include an instrument editor tab 4302, a chord grid selector tab 4303, and a chord grid editor tab 4304. According to one or more embodiments, the non-modal chord grid library window opens with the instrument editor tab 4302 selected to provide a user with quick access to all already available or newly created tunings. The already available or newly created tunings can be displayed in an instrument editor window 4305. The tunings 4306 can be listed with details such as the name assigned to the tuning, a library associated with the tuning, the number of strings associated with the tuning, the number of chords associated with the tuning, the number of basic chords associated with the tuning, and an alphanumerical representation of the notes assigned to the strings in the tuning. Each tuning may include more than one library of chord grids. One or more embodiments can provide factory library chord grid content, particularly for "normal" (EADGBE) guitar tuning, and common "open" guitar tunings, like Drop D or Open A tuning. However, in one or more embodiments, a user can input individual homemade chord grids to any library of any tuning. The non-modal chord grid library window 4301 can include an import button 4307, an export button 4308, a delete button 4309, and a create button 4310. The import button 4307 can allow a user to import a new library of chord grids for a particular tuning, and/or for a particular instrument. For example, by clicking the import button 4307 a user can import a new library created by another user or additional or new content, like a Saz or Mandolin chord grid library. The export button 4308 can allow a user to export a library that was newly created and could be sent to other users, for example customized tunings and/or chord grids for a banjo. The delete button 4309 can allow a user to remove a selected library, such as an unneeded or superfluous user library. The create button 4310 can allow a user to create a new library or libraries for a new tuning or for an already available tuning Clicking the create button 4310 can open a create library window.

Figure 44:
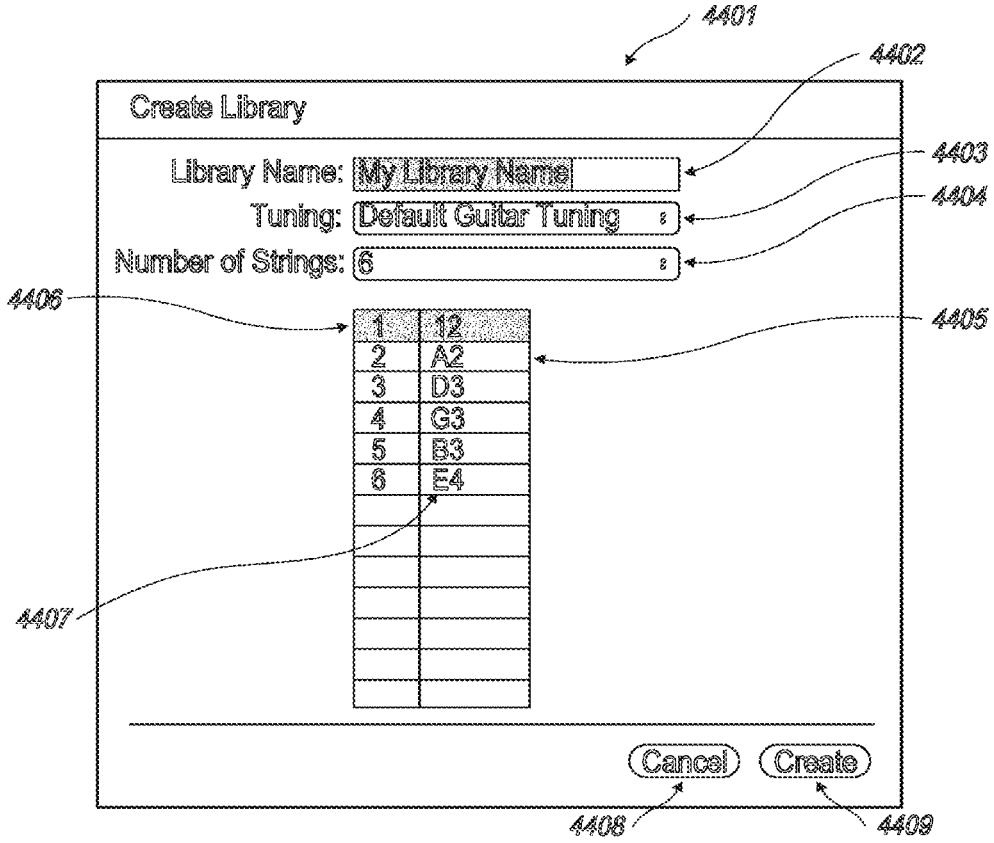
FIG. 44 depicts a screenshot of a create library window in accordance with an exemplary embodiment.

One or more embodiments can provide a convenient user interface to allow users to create a new library. Such embodiments can employ a create library window 4401, as shown in FIG. 44. The create library window can include a library name setting 4402, a tuning menu 4403, a number of strings setting 4404, and a string tuning setting submenu 4405. Based on user inputs entered into these settings and menus one or more embodiments can create a library for an existing tuning and/or for a new tuning or instrument.

To create a library for an existing tuning, according to one or more embodiments, a user can select an existing tuning from the tuning menu 4403. By selecting the existing tuning from the tuning menu 4403, the number of strings setting 4404 and the string tuning setting submenu 4405 can be automatically adjusted to display stored settings associated with the selected tuning. However, in one or more embodiments, the user can adjust or select a desired number of strings to assign to the new library by adjusting the number of strings setting 4404. In one or more embodiments, the user can adjust the settings in the string tuning setting submenu 4405, which can include string number designations 4406 and note name designations 4407. The number designations 4406 can be assigned based on the number of strings specified in the number of strings setting 4404. The note name designations 4407, however, can be editable by the user. In one or more embodiments, the user can directly type in the relevant MIDI note number or the note name into the appropriate note name designation 4407. The create library window 4401 can include a cancel button 4408 and a create button 4409. Clicking the create button 4408 can add a new library. Clicking the cancel button 4409 can revert all changes and can close the create library window 4401.

According to one or more embodiments, to create a library for a new tuning or for a new instrument, the user can input a new name for the library. The new name for the library can be entered into the library name setting 4402. Thereafter, the user can input a desired number of strings, for example, in the number of strings setting 4404. Next, the user can input the desired MIDI note number or the note name into the appropriate note name designation 4407. Finally, the user can click the create button 4409 to add the new tuning with one new library to the tunings already stored by the system. At this point, the new library will not contain any chord grids. The new tuning can be displayed in the list of tunings in the instrument editor window 4305 of the chord grid library window 4301.

Figure 45:
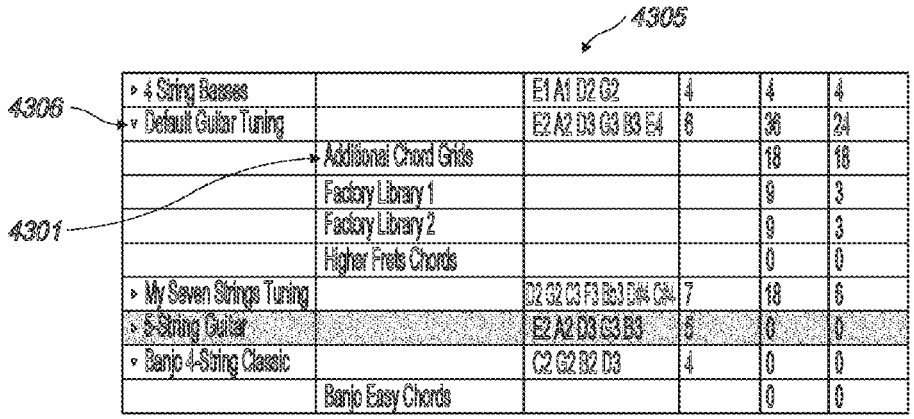
FIG. 45 depicts a screenshot of an instrument editor window in accordance with an exemplary embodiment.

FIG. 45 depicts a screenshot of an instrument editor window in accordance with an exemplary embodiment. More specifically, FIG. 45 shows a schematic of a screenshot of an instrument editor window 4305 of non-modal chord grid library 4301 with tuning 4306 expanded to show that it contains multiple libraries of guitar chords 4501. When a user creates a new tuning, the DAW can add a new tuning entry to the chord grid library. The new tuning entry can contain one new empty library to which chord grids can be added. The new empty library can be automatically named after the tuning entry. For example, if the tuning entry is named "Banjo Easy Chords," the new empty library can be automatically named "Banjo Easy Chords." The name of a tuning and/or the name of a library of guitar chords contained within a tuning can be editable by the user. For example, by double-clicking on a name and typing a different name, the user can edit the name of a tuning or a library of guitar chords within the chord grid library.

Figure 46:
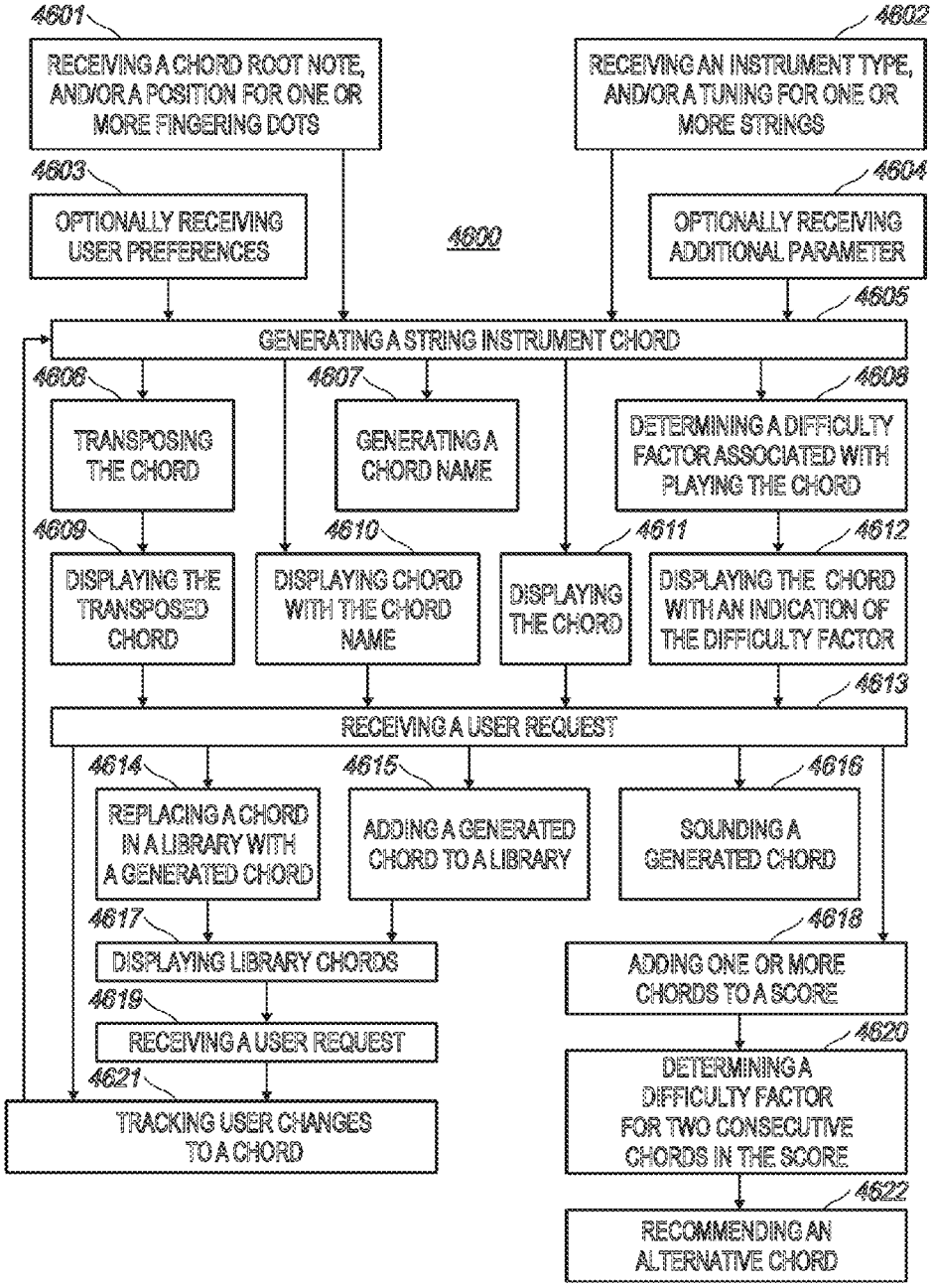
FIG. 46 depicts a flowchart of a method for generating and manipulating string-instrument chord grids in a digital audio workstation in accordance with an exemplary embodiment.

FIG. 46 depicts a flowchart of a method 4600 for generating and manipulating string-instrument chord grids in a digital audio workstation in accordance with an exemplary embodiment. The exemplary method 4600 is provided by way of example, as there are a variety of ways to carry out the method. In one or more embodiments, the method 4600 is performed by the computer 102 of FIG. 1. The method 4600 described below can be carried out using the devices illustrated in FIG. 1 by way of example, and various elements of this figure are referenced in explaining exemplary method 4600. Each block shown in FIG. 46 represents one or more processes, methods, or subroutines carried out in exemplary method 4600. The exemplary method 4600 can begin at block 4601.

The method 4600 can involve receiving a first data input, as illustrated at block 4601. For example, the computer 102, e.g., first processor, can receive a first data input. The first data input can include a chord root note and/or a position for one or more fingering dots. For example, a user could specify F as a root note and/or fingering positions for an F-minor chord as shown in FIG. 10. Specification of fingering positions can be accomplished by clicking on a chord grid.

The method 4600 can involve receiving a second data input, as illustrated at block 4602. For example, the computer 102, e.g., first processor, can receive a second data input. The second data input can include an instrument type, and/or a tuning for one or more strings. For example, a user could specify a banjo, an acoustic guitar, or a mandolin as an instrument type. Specifying an instrument type can indicate at least a number of frets and a number of strings. A default tuning may be indicated upon specifying an instrument type. According to certain embodiments, a user can specify a tuning for one or more strings.

The method 4600 can involve receiving other optional data, as illustrated at blocks 4603 and 4604. For example, the computer 102, e.g., first processor, can receive other optional data. As illustrated at block 4603, user preferences can be received. User preferences can include information such as that specified in FIG. 7, including but not limited to chord scaling, grid scaling, whether fingering numbers should be displayed, whether chord names should be displayed, the minimum number of frets to be displayed, a font, etc. As illustrated at block 4604, an additional parameter 4604 can be received. Additional optional parameters can include an additional parameter relevant for generating a string-instrument chord grid, for example, the position of a capo.

As illustrated at block 4605, the method 4600 can involve generating a string instrument chord grid based on the first data input, the second data input, the optional user preferences, and the optional additional data. For example, the computer 102, e.g., first processor, can generate a string instrument chord grid based on the first data input, the second data input, the optional user preferences, and the optional additional data.

Once the chord grid is generated the method 4600 can involve displaying the chord grid, as illustrated at block 4611. For example, the computer 102, e.g., first processor, can prompt the display of a generated chord grid on a monitor.

In some embodiments, once the chord grid is generated, the method 4600 can involve transposing the chord grid, as illustrated at block 4606. For example, the computer 102, e.g., first processor, can transpose the chord grid, as discussed, for example, with respect to FIG. 16. One or more embodiments can display both the transposed chord and the originally generated chords. In some embodiments, the method 4600 can involve displaying a series of transposed chords, as illustrated at block 4609. For example, the computer 102, e.g., first processor, can display a series of transposed chords.

The method 4600 can involve generating a chord name, as illustrated at block 4607. For example, the computer 102, e.g., first processor, can generate a chord name. The method 4600 can involve displaying the chord name on the chord grid, as illustrated at block 4610. In some embodiments a difficulty factor or rating associated with playing the chord can be determined 4608, and the chord can be displayed with an indication of the difficulty factor 4612.

Upon displaying a chord or a series of chords, the method 4600 can involve receiving a user request, as illustrated at block 4613. For example, the computer 102, e.g., first processor, can receive a user request before, after, or while displaying a chord or series of chords.

In one or more embodiments, receiving the user request, as illustrated at block 4613, can prompt the replacement of a chord in a library with the generated chord, as illustrated at block 4614. For example, the computer 102, e.g., first processor, can receive a user request and replace a chord in a library stored on local or external memory with a generated chord based on the user request.

In one or more embodiments, receiving the user request, as illustrated at block 4613, can prompt the generated chord to be added to a library, as illustrated at block 4615. For example, the computer 102, e.g., first processor, can receive a user request and add a generated chord to a library stored on local or external memory.

In one or more embodiments, receiving the user request, as illustrated at block 4613, can prompt the sounding of the generated chord, as illustrated at block 4616. The generated chord can be sounded as either a strummed chord, or an arpeggio For example, the computer 102, e.g., first processor, can receive a user request and prompt a chord to be sounded on one or more sound output devices 112, 114.

In one or more embodiments, receiving the user request, as illustrated at block 4613, can result in the chord being added to a score, as illustrated at block 4618. For example, the computer 102, e.g., first processor, can receive a user request and add a chord to a musical score.

Upon adding one or more chords to a score, as illustrated at block 4618, the method 4600 can involve determining a difficulty factor for consecutive chords in the score, as illustrated at block 4620. For example, the computer 102, e.g., first processor, can compare consecutive chords in a score and generate a difficulty factor associated with playing the chords in sequence. The method 4600 can include recommending an alternate chord, as illustrated at block 4622. For example, if the difficulty factor exceeds a threshold factor associated with a user, an alternate chord can be recommended. For example, the computer 102, e.g., first processor, can select an alternate chord, rated as being more or less difficult than a chord in the score by comparing a difficulty rating of the chord in the score with a difficulty rating associated with one or more chords stored as alternatives to the chord in the score.

In one or more embodiments, receiving the user request, as illustrated at block 4613, can result in tracking user changes to the generated chord, as illustrated at block 4621. For example, the computer 102, e.g., first processor, can receive and track user changes to a chord. The user changes can be inputted to the computer 102 via an input device such as a mouse.

Upon tracking user changes to a chord, the method 4600 can involve generating a new string instrument chord 4605. For example, the computer 102, e.g., first processor, can generate a new string instrument chord, which can include positions for regular or optional fingering dots, position of a bane, a fret number indication, a chord name, and other tablature and fingering markings.

If receiving the user request, as illustrated at block 4613, prompts replacing a chord in a library, as illustrated at block 4614, or adding a generated chord to a library, as illustrated at block 4615, the method 4600 can include displaying chords in the library, as illustrated at 4617. For example, the computer 102, e.g., first processor, can prompt a monitor to display one or more chords in a library. Thereafter, the method 4600 can include receiving a further user request, as illustrated at block 4619. For example, the computer 102, e.g., first processor, can receive a further user request.

In one or more embodiments, receiving the user request, as illustrated at block 4619, can result in tracking changes to a chord, as illustrated at block 4621. For example, the computer 102, e.g., first processor, can receive and track user changes to a chord. The user changes can be inputted to the computer 102 via an input device such as a mouse.

Upon tracking user changes to a chord, as illustrated at block 4621, the method 4600 can involve generating a new string instrument chord, as illustrated at block 4605. For example, the computer 102, e.g., first processor, can receive and track user changes to a chord and then generate a new string instrument chord, which can include positions for regular or optional fingering dots, position of a barré, a fret number indication, a chord name, and other tablature and fingering markings.

In one or more embodiments, receiving the user request, as illustrated at block 4619, can result in adding one or more selected chords from the library to a score, as illustrated at block 4618. For example, the computer 102, e.g., first processor, can receive a user request and add one or more selected chords from a library stored locally or externally to a score.

The technology can take the form of an entirely hardware embodiment, an entirely software embodiment or an embodiment containing both hardware and software elements. In one embodiment, the invention is implemented in software, which includes but is not limited to firmware, resident software, microcode, etc. Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD. Both processors and program code for implementing each as aspect of the technology can be centralized and/or distributed as known to those skilled in the art.

The above disclosure provides examples and aspects relating to various embodiments within the scope of claims, appended hereto or later added in accordance with applicable law. However, these examples are not limiting as to how any disclosed aspect may be implemented, as those of ordinary skill can apply these disclosures to particular situations in a variety of ways.

What is claimed is:

1. A computer-implemented method, comprising:

receiving musical notation data including two or more note locations on a stringed instrument, the stringed instrument including a number of strings and a number of frets, wherein each note location corresponds to a particular fret and particular string of the stringed instrument, and wherein the two or more note locations define a chord;

receiving stringed instrument data identifying a musical instrument, wherein the stringed instrument data includes tuning data for each of the number of strings on the musical instrument;

determining difficulty criteria corresponding to the difficulty of physically playing the chord on a stringed instrument, wherein the difficulty criteria is determined using one or more physical fingering criteria for the stringed instrument; and determining a difficulty rating for the musical notation data using the difficulty criteria, the stringed instrument data and the two or more note locations defining the chord, wherein the difficulty rating represents the physical difficulty of a fingering required to form the chord on the stringed instrument.

2. The method of claim 1, further comprising:

recommending one or more alternate chords using the difficulty rating.

3. The method of claim 1, further comprising:

receiving additional musical notation data;

receiving additional stringed instrument data; and determining an additional difficulty rating for the additional musical notation data.

4. The method of claim 3, further comprising:

determining an aggregate difficulty rating using the difficulty rating and the additional difficulty rating, wherein the aggregate difficulty rating is a sum of the difficulties for the difficulty rating and the additional difficulty rating.

5. The method of claim 4, wherein the musical notation data and the additional musical notation data include key data and tuning data, and wherein one or more alternate keys or tunings are recommended based upon the aggregate difficulty rating.

6. The method of claim 3, further comprising:

determining a transitional difficulty rating using the difficulty rating and the additional difficulty rating, wherein the transitional difficulty rating defines a difficulty of transitioning between musical notation data and the additional musical notation data.

7. The method of claim 6, wherein the musical notation data and the additional musical notation data include key data and tuning data, and wherein one or more alternate keys or tunings are recommended based upon the transitional difficulty rating.

8. A computer-implemented system, comprising:

one or more processors;

one or more non-transitory computer-readable storage media containing instructions configured to cause the one or more processors to perform operations including:

receiving musical notation data including two or more note locations on a stringed instrument, the stringed instrument including a number of strings and a number of frets, wherein each note location corresponds to a particular fret and particular string of the stringed instrument, and wherein the two or more note locations define a chord;

receiving stringed instrument data identifying a musical instrument, wherein the stringed instrument data includes tuning data for each of the number of strings on the musical instrument;

determining difficulty criteria corresponding to the difficulty of physically playing the chord on a stringed instrument, wherein the difficulty criteria is determined using one or more physical fingering criteria for the stringed instrument; and determining a difficulty rating for the musical notation data using the difficulty criteria, the stringed instrument data and the two or more note locations defining the chord, wherein the difficulty rating represents the physical difficulty of a fingering required to form the chord on the stringed instrument.

9. The system of claim 8, further comprising instructions configured to cause the one or more processors to perform operations including:

recommending one or more alternate chords using the difficulty rating.

10. The system of claim 8, further comprising instructions configured to cause the one or more processors to perform operations including:

receiving additional musical notation data;

receiving additional stringed instrument data; and determining an additional difficulty rating for the additional musical notation data.

11. The system of claim 10, further comprising instructions configured to cause the one or more processors to perform operations including:

determining an aggregate difficulty rating using the difficulty rating and the additional difficulty rating, wherein the aggregate difficulty rating is a sum of the difficulties for the difficulty rating and the additional difficulty rating.

12. The system of claim 11, wherein the musical notation data and the additional musical notation data include key data and tuning data, and wherein one or more alternate keys or tunings are recommended based upon the aggregate difficulty rating.

13. The system of claim 10, further comprising instructions configured to cause the one or more processors to perform operations including:

determining a transitional difficulty rating using the difficulty rating and the additional difficulty rating, wherein the transitional difficulty rating defines a difficulty of transitioning between musical notation data and the additional musical notation data.

14. The system of claim 13, wherein the musical notation data and the additional musical notation data include key data and tuning data, and wherein one or more alternate keys or tunings are recommended based upon the transitional difficulty rating.

15. A computer-program product tangibly embodied in a non-transitory computer-readable storage medium, including instructions configured to cause a data processing system to:

receive musical notation data including two or more note locations on a stringed instrument, the stringed instrument including a number of strings and a number of frets, wherein each note location corresponds to a particular fret and particular string of the stringed instrument, and wherein the two or more note locations define a chord;

receive stringed instrument data identifying a musical instrument, wherein the stringed instrument data includes tuning data for each of the number of strings on the musical instrument;

determine difficulty criteria corresponding to the difficulty of physically playing the chord on a stringed instrument, wherein the difficulty criteria is determined using one or more physical fingering criteria for the stringed instrument; and determine a difficulty rating for the musical notation data using the difficulty criteria, the stringed instrument data and the two or more note locations defining the chord, wherein the difficulty rating represents the physical difficulty of a fingering required to form the chord on the stringed instrument.

16. The computer-program product of claim 15, further comprising instructions configured to cause a data processing system to:

recommend one or more alternate chords using the difficulty rating.

17. The computer-program product of claim 15, further comprising instructions configured to cause a data processing system to:

receive additional musical notation data;

receive additional stringed instrument data; and determine an additional difficulty rating for the additional musical notation data.

18. The computer-program product of claim 17, further comprising instructions configured to cause a data processing system to:

determine an aggregate difficulty rating using the difficulty rating and the additional difficulty rating, wherein the aggregate difficulty rating is a sum of the difficulties for the difficulty rating and the additional difficulty rating.

19. The computer-program product of claim 18, wherein the musical notation data and the additional musical notation data include key data and tuning data, and wherein one or more alternate keys or tunings are recommended based upon the aggregate difficulty rating.

20. The computer-program product of claim 17, further comprising instructions configured to cause a data processing system to:

determine a transitional difficulty rating using the difficulty rating and the additional difficulty rating, wherein the transitional difficulty rating defines a difficulty of transitioning between musical notation data and the additional musical notation data.

21. The computer-program product of claim 20, wherein the musical notation data and the additional musical notation data include key data and tuning data, and wherein one or more alternate keys or tunings are recommended based upon the transitional difficulty rating.

* * * * *